US008182374B1

(12) United States Patent
Copeland

(10) Patent No.: US 8,182,374 B1
(45) Date of Patent: May 22, 2012

(54) PORTABLE PING-PONG SET

(75) Inventor: Stephan Copeland, Merion Station, PA (US)

(73) Assignee: Umbra LLC, Buffalo, NY (US)

( * ) Notice: Subject to any disclaimer, the term of this patent is extended or adjusted under 35 U.S.C. 154(b) by 0 days.

(21) Appl. No.: 13/288,532

(22) Filed: Nov. 3, 2011

(51) Int. Cl.
*A63B 61/00* (2006.01)
*A63B 61/02* (2006.01)
*A63B 59/04* (2006.01)

(52) U.S. Cl. ..... 473/473; 473/491; 473/492; 473/494

(58) Field of Classification Search ..... 473/527, 473/531, 490–492, 494, 496
See application file for complete search history.

(56) References Cited

U.S. PATENT DOCUMENTS

| | | | | |
|---|---|---|---|---|
| 1,832,298 | A * | 11/1931 | Greenspan | 473/531 |
| 2,109,799 | A | 3/1938 | Moore | |
| 2,767,854 | A | 10/1956 | Barrett | |
| 3,842,979 | A | 10/1974 | Doelcher | |
| 3,863,921 | A * | 2/1975 | Price | 473/491 |
| 4,026,449 | A | 5/1977 | Kevin | |
| 4,052,060 | A | 10/1977 | Balkcom | |
| D277,147 | S | 1/1985 | Shellman, Sr. | |
| 4,595,155 | A * | 6/1986 | Gough | 242/395.1 |
| 4,850,590 | A | 7/1989 | Lin | |
| 4,915,382 | A | 4/1990 | Madsen | |
| 4,993,719 | A * | 2/1991 | Hernandez | 473/492 |
| 5,139,258 | A | 8/1992 | McPoyle | |
| 5,368,172 | A | 11/1994 | Barringer | |
| 5,749,574 | A | 5/1998 | Curtis | |
| 7,104,903 | B1 * | 9/2006 | Chen | 473/491 |
| 2006/0205541 | A1 | 9/2006 | D'Estais | |

FOREIGN PATENT DOCUMENTS

| | | |
|---|---|---|
| CN | 2882715 | 3/2007 |
| CN | 201216847 | 4/2009 |
| CN | 101574577 | 11/2009 |
| CN | 201441794 | 4/2010 |
| DE | 20015191 | 3/2001 |
| DE | 10037265 | 2/2002 |
| DE | 202006004197 | 9/2006 |
| KR | 447057 | 12/2009 |

OTHER PUBLICATIONS http://ep.yimg.com/ca/l/gadgetbargains_2165_36652471, last viewed Jul. 22, 2011.
http://shop.monkeybusinesssports.com/table-top-sports.aspx. last viewed Jul. 25, 2011.
http://www.areyougame.com/Interact/item.asp?q=ping%2Bpong &qmehod=0&itemno=MBS521..., last viewed Jul. 25, 2011.

* cited by examiner

*Primary Examiner* — Raleigh W. Chiu
(74) *Attorney, Agent, or Firm* — Simpson & Simpson, PLLC

(57) ABSTRACT

A portable ping pong set having a net assembly comprising a first post having a first base member, a second post having a second base member, and a net fixedly secured within each of the first and second posts and extendible therebetween, the first and second base members operatively arranged to form an assembly base when the first and second base members are proximate one another, the assembly base having a first shape when the first and second base members are proximate one another; and, a paddle having a blade and retractable handle, the blade having a second shape, wherein the first shape and the second shape are substantially similar when the handle is retracted into the blade.

19 Claims, 16 Drawing Sheets

Fig. 10A
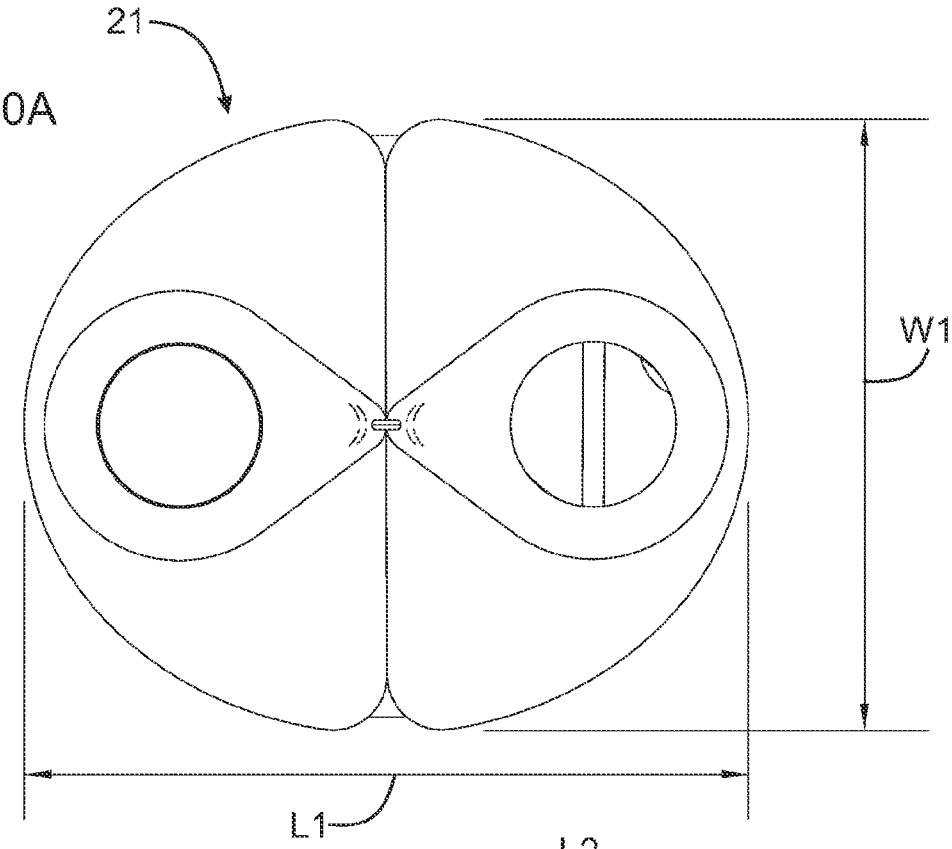
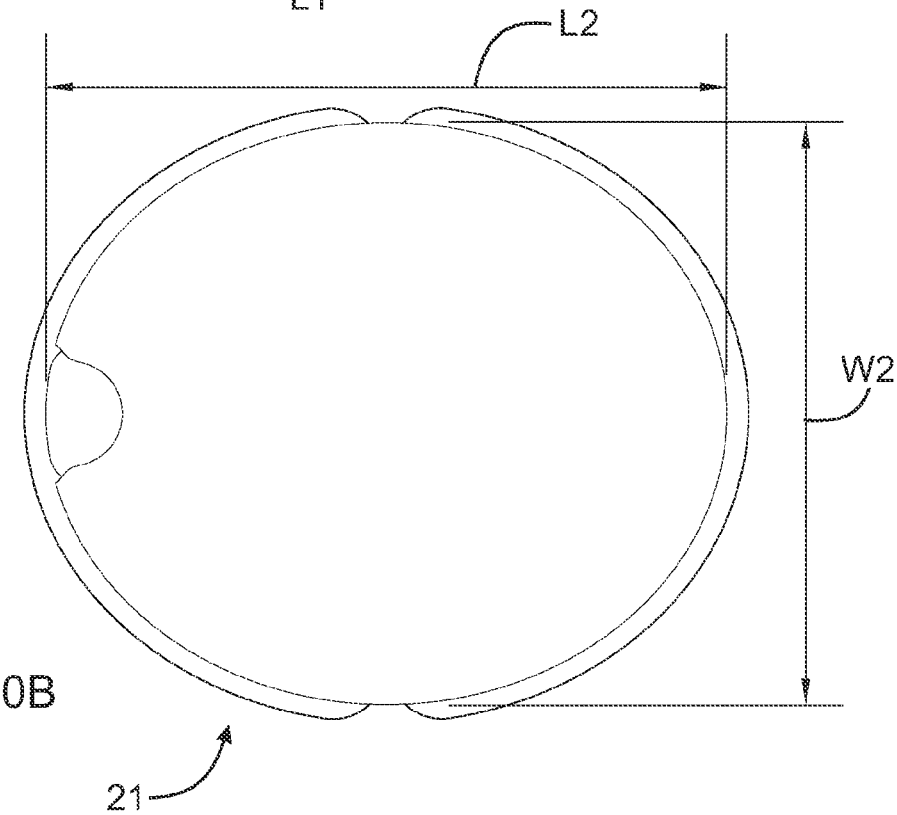
Fig. 10B

PORTABLE PING-PONG SET

FIELD OF THE INVENTION

The invention is a ping-pong game set and, more particularly, a portable ping-pong game set assembly that can be used to play ping-pong on any flat surface and, in particular, on tables or flat surfaces of varying widths. The present invention comprises a retractable net assembly and paddles having retractable handles for portability and compact packaging. The net assembly of the present invention includes a storage chamber for ping-pong balls.

BACKGROUND OF THE INVENTION

Ping-pong, or table tennis, is a well-known game involving usually two or four players where players use ping-pong paddles to serve and rally a ping-pong ball for points. When there are two players the game is referred to as a singles game. When there are four players the game is referred to as a doubles game. Sometimes a single player can play against a wall or some other flat surface; the game is then referred to as a solo game. In competitive ping-pong, players compete for matches where a winning match is the best of any odd number of games chosen, for example, 3 of 5 games, 4 of 7 games, or 5 of 9 games. For each game, the first player to reach 11 points wins that game, however a game must be won by at least a two point margin. If both sides earn 10 points the game is won by the first side to subsequently earn a lead of 2 points.

Play commences after a player or a pair of players chooses, for example, by winning a coin toss, to serve, to receive first, or to start at a particular end. The other player or pair assumes the opposing position: to receive, to serve first, or to start at the end opposite from the particular end chosen by the other player or pair. The game commences when a player puts a ball into play by being the first to strike the ball for a point, or putting the ball in service or serving the ball. A ball is put in service when a player (also referred to as the server): (1) holds the ball freely on the open palm of her stationary and free hand; (2) projects the ball in a nearly vertical direction, without imparting spin, so that it rises at least 16 cm after leaving the server's palm and then falls without touching anything before being struck; (3) as the ball falls, strikes the ball with a paddle so that the ball touches her court and then, after passing over or around the net assembly, touches directly the receiver's court (in doubles, the ball shall touch successively the right half court of server and receiver). At all times during a serve the ball is above the level of the playing surface and behind the server's end line and it shall not be hidden from the receiver by any part of the body or clothing of the server or her double's partner.

Points are scored after each ball is put into play (not just when the server wins the point as in volleyball). If the ball makes contact with the net during the serve, otherwise known as a let, the rally is not scored and the ball is served again. So long as the serve is implemented according to the steps outlined above, the ball is in play and the receiver must return the ball. The receiver returns the ball by striking the ball with her paddle so that it passes over or around the net assembly and touches the opponent's court, either directly or after touching the net assembly. Then either player may win the point. A player can win a point in the follows ways: (1) if the opponent server fails to make a good service; (2) if the opponent receiver fails to make a good return; (3) if, after he has made a good service or a good return, the ball touches anything other than the net assembly before being struck by his opponent; (4) if the ball passes beyond his end line without touching his court, after being struck by his opponent; (5) if his opponent obstructs the ball; (6) if his opponent strikes the ball twice successively; (7) if his opponent, or anything his opponent wears or carries, moves the playing surface; (8) if his opponent, or anything his opponent wears or carries, touches the net assembly; (9) if his opponent's free hand touches the playing surface; and (10) if a doubles opponent strikes the ball out of the sequence established by the first server and first receiver (in doubles the server shall first make a good service, the receiver shall then make a good return, the partner of the server shall then make a good return, the partner of the receiver shall then make a good return and thereafter each player in turn in that sequence shall make a good return). It should be appreciated that these are some of the standard ways points are earned in a game of ping-pong but there are other ways points may be earned.

Competitive ping-pong is governed by the ITTF, the International Table Tennis Federation. The ITTF was founded in 1926, the nine founding members being Austria, Czechoslovakia, Denmark, England, Germany, Hungary, India, Sweden and Wales. The first international tournament was held in January 1926 in Berlin while the first World Table Tennis Championships was held in December 1926 in London. The role of the ITTF includes overseeing rules and regulations and seeking technological improvement for the sport of table tennis. The ITTF is responsible for the organization of numerous international competitions, including the World Table Tennis Championships that has continued since 1926. Over the years, ping-pong has maintained a steady interest among competitive players and non-competitive players.

Traditional ping-pong sets include a table, a net assembly, paddles and balls, and are expensive, heavy, and bulky. An example of a prior art ping-pong set is shown in FIG. 1, which illustrates a perspective view of ping-pong game set assembly 1 comprising table 2, net 8, net tensioning brackets 6A and 6B, bracket clamps 6C and 6D, paddles 4A and 4B, and ball 5. Ball 5 is typically spherical, hollow, lightweight, and made of celluloid or some other lightweight plastic to ensure high-bouncing capability. Ball 5 is usually white or some other color that contrasts with the color of the table so that users can easily see the ball when playing. Originally, the standard ping-pong ball was 38 mm, or 1.5 inches, in diameter. After the 2000 Olympic Games, however, the 38 mm ball was replaced by a 40 mm ball, which is identical in material, but since the diameter is larger, ball 5 is slower and spins less than the traditional ping-pong ball.

Paddles 4A and 4B, as illustrated in FIG. 1, each comprise a blade and a handle. Paddles 4A and 4B usually have between one and seven plies of wood, although cork, glass fiber, carbon fiber, aluminum fiber, and para-aramid synthetic fiber, such as Kevlar® brand synthetic fiber, are sometimes used. The blades of paddles 4A and 4B are usually elliptical in shape, laminated, and covered with an anti-slip material such as rubber. The average size of a blade is about 6.5 inches (16.5 cm) long and 6 inches (15 cm) wide. Although there are no official restrictions on the shape or size of the blade itself, these dimensions are optimal for most play styles. It is customary for the blade and handle to be fixedly secured to one another. In some cases, the blade and handle are carved out of a single mass of material.

Net tensioning brackets 6A and 6B and bracket clamps 6C and 6D are arranged to secure net 8 across the top of table 2. Net tensioning brackets 6A and 6B are usually made of a rigid material. Bracket clamps 6C and 6D are usually made of some rigid material and comprise a device which is attachable to table 2 and operatively arranged to maintain the upright arrangement of net tensioning brackets 6A and 6B which are arranged to maintain the upright, fully extended, and taut arrangement of net 8 across the top of table 2. Net 8 is made of a lightweight mesh material and typically about 5 feet long and approximately 6 inches tall. Table 2 is typically about 5 feet wide to accommodate the length of net 8.

The ping-pong set assembly shown in FIG. 1 poses a number of limitations. Firstly, the ping-pong net assembly is suitable for game play only on tables of a particular width. The net assembly is not suitable for use and game play on a table having a width less than or greater than the width of the net. Secondly, this conventional ping-pong set is bulky. Thirdly, the ping-pong net assembly shown is cumbersome to remove because removing it involves unclamping, unscrewing, or otherwise undoing clamps 6C and 6D from table 2. A fourth limitation posed by the ping-pong net assembly shown is that net 8, net tensioning brackets 6A and 6B, and bracket clamps 6C and 6D are permanently exposed. Thus, they can be damaged easily. A fifth limitation is that net tensioning brackets 6A and 6B and bracket clamps 6C and 6D become loosened and require fine-tuning to ensure net 8 is upright, fully extended, and taut across the top of table 2. The fine-tuning required is inconvenient for a player because it takes time away from game play. The fine-tuning required is also inconvenient because it is often difficult for a user to accurately set net tensioning brackets 6A and 6B and bracket clamps 6C and 6D so that net 8 is fully extended and taut. Additionally, the fine-tuning can cause wear and tear on table 2. A sixth limitation is that paddles 4A and 4B have an awkward shape thus, they are not easy to store and/or pack. Yet another limitation is that the ping-pong set assembly shown in FIG. 1 has no convenient place to store ball 5. Finally, the net assembly shown in FIG. 1 must be clamped to a table top, and not all table tops are suitable for clamping.

Patentees and applicants for patents have addressed other problems related to the game of ping pong and other racquet sports. For example, U.S. Pat. No. 4,850,590 (Lin) discloses an adjustable ping-pong net assembly comprising a net, first and second vertical hollow cylinders each having net supports, two base pieces having clamps, and a spring-biased shaft to tension the net when the supports are mounted on opposite sides of the table. One end of the net is fixedly secured within the first hollow cylinder containing the coiled spring-biased shaft while the other end of the net is fixed to a stopper which is operatively arranged to be inserted into the second hollow cylinder for game play. When the net assembly is not in use, a user can remove the net from the second hollow cylinder and allow the spring-biased shaft within the first hollow cylinder to automatically wind the net. The retractable ping-pong net assembly disclosed is problematic because the stopper can deform due to repeated assembly and disassembly. Additionally, a piece of dirt or debris can clog the second hollow cylinder which is intended to receive the stopper of the net thereby preventing assembly. Furthermore, the automatic spring-biased shaft can malfunction due to its complexity. This reference also fails to disclose a storage chamber for a ping-pong ball.

U.S. Patent Application No. 2006/0205541 (D'Estais) discloses an adjustable net assembly including two supports each having a fastening means and an automatic net winder. Although this reference discloses an adjustable table tennis net assembly that improves the compatibility of the traditional ping-pong net assembly with tables of varying widths, the invention suffers from a few disadvantages. Firstly, the invention includes an interlocking alignment of the two supports when the supports are proximate and in contact with one another. A problem with this interlocking alignment is that the bottom-most portions of the two supports are not planar. Instead, the bottom-most portions of the two supports are arranged where one support is beneath the other. Given this arrangement, the net supports cannot be arranged upright on a flat surface. Rather, the net supports can only be arranged along a flat surface longitudinally. This longitudinal arrangement takes up more space than an upright perpendicular arrangement. Secondly, this reference discloses net supports having a fastening means to fix the net assembly to a table. As discussed above, a net assembly having a fastening means is cumbersome. Thirdly, the automatic winder disclosed is complex and therefore expensive to manufacture.

As described previously, most ping-pong paddles are of one-piece, unitary construction. This paddle structure requires a larger package for shipping and retail sales. Others have noticed this issue in other racquet sports. For example, U.S. Pat. No. 5,749,574 (Curtis) is directed to a collapsible tennis racquet comprising a racquet head and a detachable handle. This racquet includes a detachable handle, however, and not a non-detachable, retractable handle, resulting in less space savings for packaging, and a chance that the handle or head will be lost or misplaced.

Therefore, there is a long-felt need for a portable ping-pong set that can be arranged quickly and easily on any flat surface. There is also a long-felt need for a ping-pong set assembly that stores compactly. There is also a long-felt need for a ping-pong net assembly that has an adjustable net length so the net assembly can accommodate tables of varying widths, and can rest atop a table surface without clamping. Finally, there is a long-felt need for a ping-pong paddle having a non-detachable, retractable handle.

BRIEF SUMMARY OF THE INVENTION

The present invention comprises a portable ping-pong set having a net assembly comprising a first post having a first base member, a second post having a second base member, and a net fixedly secured within each of the first and second posts and extendible therebetween, the first and second base members operatively arranged to form an assembly base when the first and second base members are proximate and in contact with one another, the assembly base having a first shape when the first and second base members are proximate and in contact with one another, and a paddle having a blade and retractable handle, the blade having a second shape when the handle is retracted into the blade, wherein the first shape and the second shape are substantially similar. In a preferred embodiment, the first post has a storage compartment for game balls and the second post has a manual winder to retract the net. In a preferred embodiment the length of the net is adjustable.

A general object of the present invention is to provide a portable ping-pong set that can be used to play ping-pong on any flat surface.

Another object of the present invention is to provide a ping-pong set having an adjustable net length that can accommodate tables of varying widths.

Another object of the present invention is to provide a portable ping-pong set having a retractable net assembly.

Another object of the present invention is to provide a ping-pong paddle having a non-detachable, retractable handle.

Still another object of the present invention is to provide a net assembly having a manually retractable net.

A further object of the present invention is to provide a weighted net assembly (i.e., a net assembly having posts with low centers of gravity and sufficient weight to remain stable during a ping-pong game.)

Yet a further object of the present invention is to provide a net assembly that rests atop a playing surface without clamping.

Yet another object of the present invention is to provide a net assembly having a manual winder operatively arranged to retract the net.

Still a further object of the present invention is to provide a portable ping-pong set including a storage chamber for ping-pong balls.

These and other objects and advantages of the present invention will be readily appreciable from the following description of preferred embodiments of the invention and from the accompanying drawings and claims.

BRIEF DESCRIPTION OF THE SEVERAL VIEWS OF THE DRAWING

The nature and mode of operation of the present invention will now be more fully described in the following detailed description of the invention taken with the accompanying drawing figures, in which:

FIG. 10A is a top plan view of the portable ping-pong set shown in FIG. 3;

FIG. 10B is a bottom plan view of the portable ping-pong set shown in FIG. 3;

DETAILED DESCRIPTION OF THE INVENTION

At the outset, it should be appreciated that like drawing numbers on different drawing views identify identical, or functionally similar, structural elements of the invention.

While the present invention is described with respect to what is presently considered to be the preferred aspects, it is to be understood that the invention as claimed is not limited to the disclosed aspect. The present invention is intended to include various modifications and equivalent arrangements within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
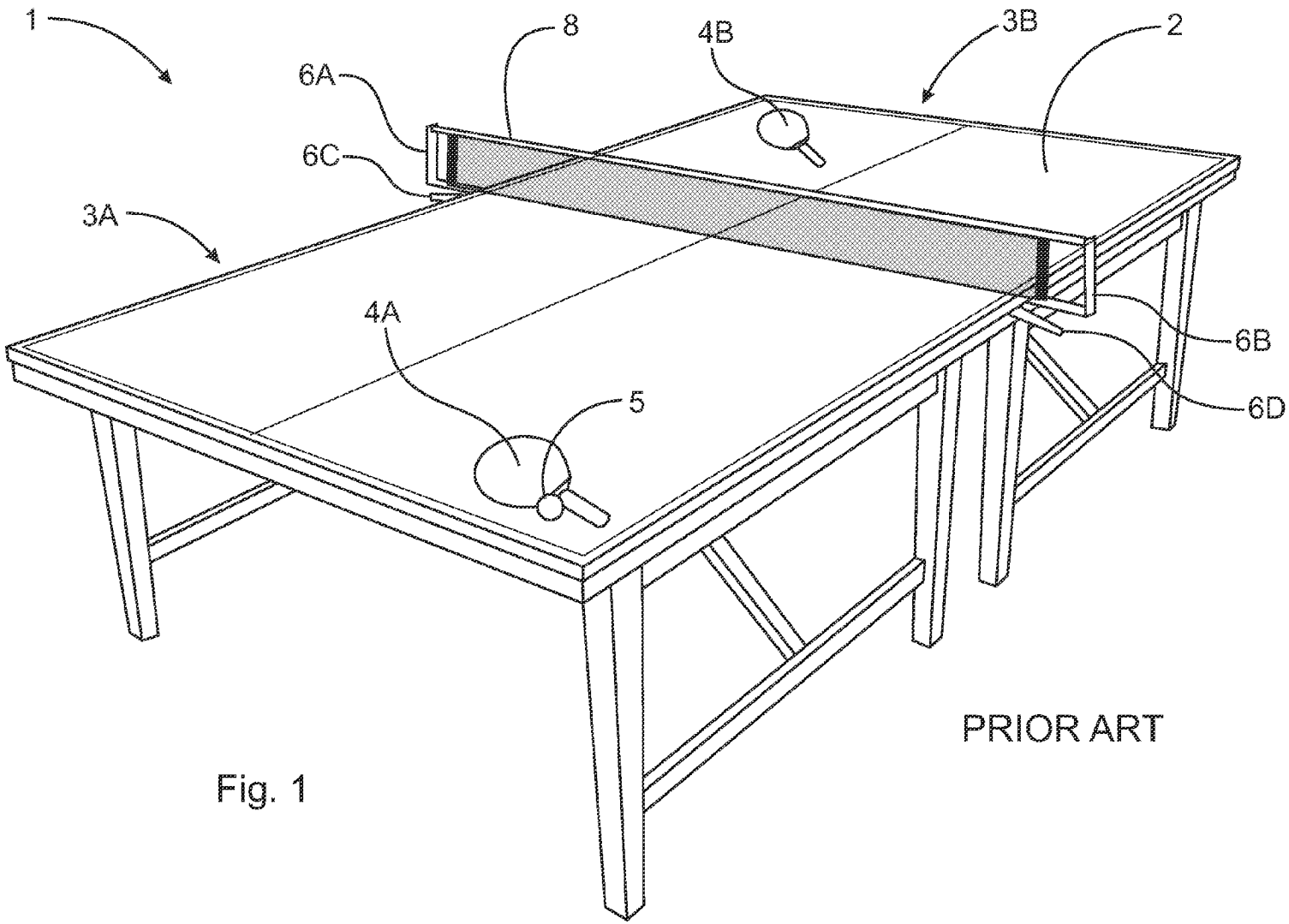
FIG. 1 is a perspective view of a typical prior art ping-pong game set assembly.
Figure 2:
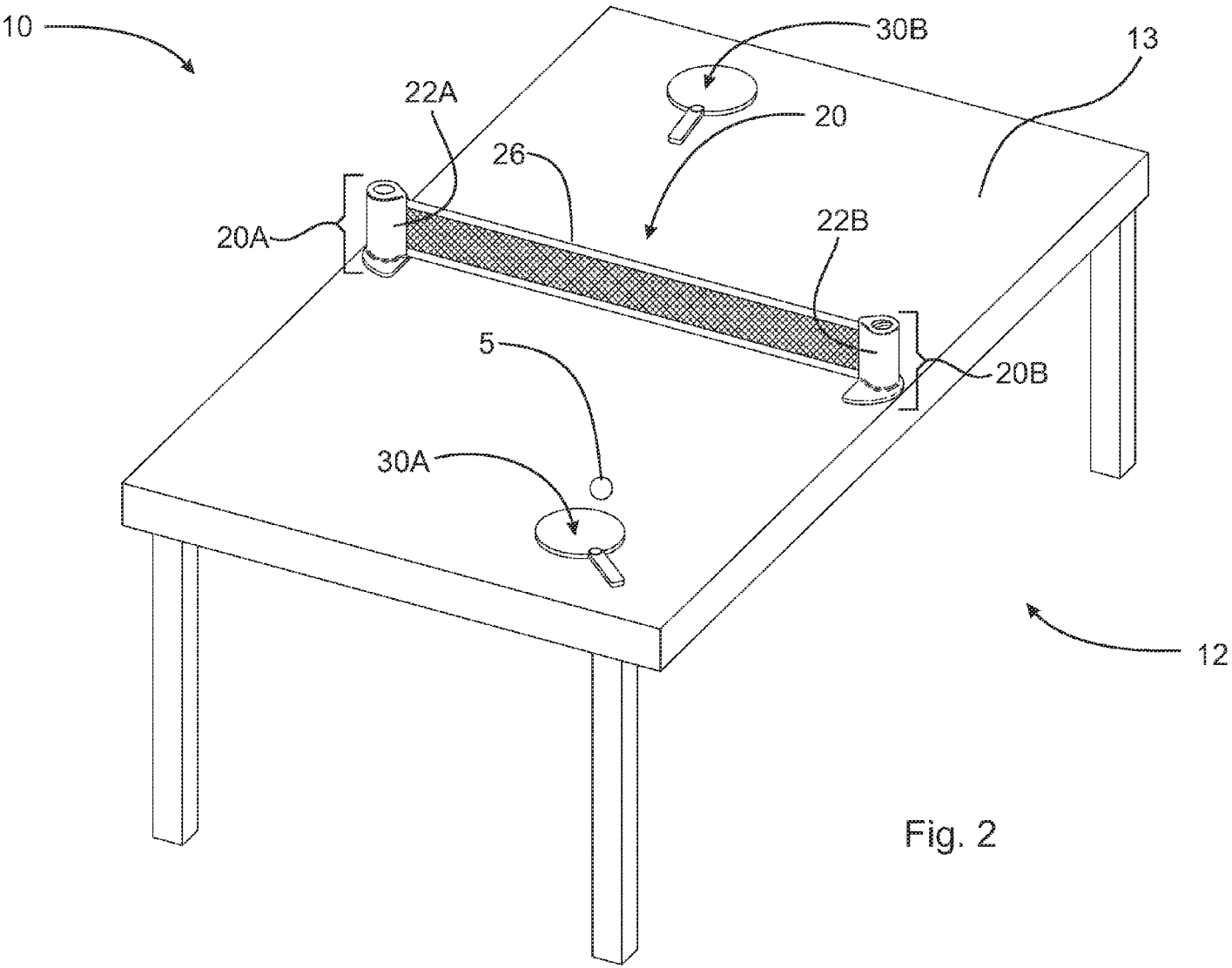
FIG. 2 is a perspective view of the portable ping-pong set of the present invention shown in use on a table.

Adverting again to the figures, FIG. 2 is a perspective view of portable ping-pong set 10 of the present invention, shown atop table 12 having planar top surface 13. In a preferred embodiment, portable ping-pong set 10 comprises net assembly 20, (which includes net 26, first paddle 30A, and second paddle 30B.) The set optionally includes ping-pong ball 5. Net 26 is shown upright, fully extended, and perpendicular to planar top surface 13. As shown in FIG. 2, portable ping-pong set 10 rests atop planar top surface 13 and is not clamped or otherwise secured to table 12. Net assembly 20 can extend and retract to accommodate tables of varying widths and can be used on any planar surface. Although the preferred embodiment comprises two paddles and a net assembly, it should be appreciated that portable ping-pong set 10 can include any number of paddles or balls to accommodate single or multiple players.

Figure 3:
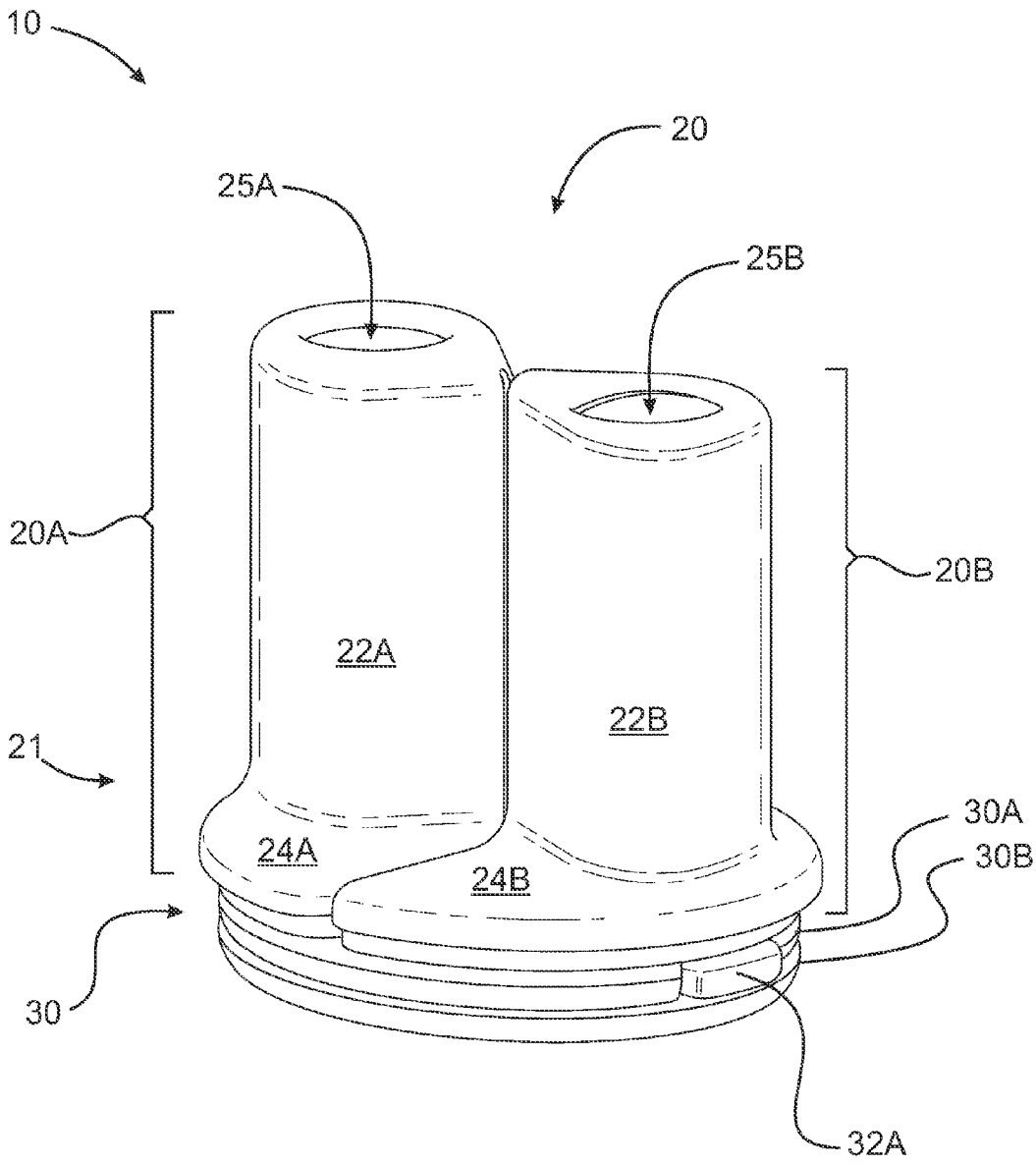
FIG. 3 is a perspective view of the assembly base of the portable ping-pong set, having the first and second posts and the first and second base members shown proximate one another resting atop two paddles with their handles retracted.

FIG. 3 is a perspective view of net assembly 20 of portable ping-pong set 10, having first post 22A and second post 22B, first base member 20A and second base member 20B, and paddle pair 30. First post 22A and second post 22B are shown parallel and proximate to one another. First base member 20A and second base member 20B form base assembly 21. Net 26 (best shown in FIG. 5) is coiled, or retracted, within second post 22B and fixedly secured to first post interior surface 90A (shown in FIG. 9A). It should be appreciated that net 26 can be secured at any point along first post interior surface 90A. Paddle pair 30 includes first paddle 30A and second paddle 30B. First paddle 30A rests below and parallel to base assembly 21. Second paddle 30B rests below and parallel to first paddle 30A, such that first paddle 30A is interposed between base assembly 21 and second paddle 30B. When base assembly 21, first paddle 30A, and second paddle 30B are stacked atop one another, the perimeters of each assembly align to appear as a single unit. Thus, this stackable relationship contributes, in part, to the increased portability of the present invention. Additionally, the stackable relationship also enables a user to store the ping-pong set more easily and efficiently on a shelf or in a box or bag. This also minimizes packaging expense and retail shelf space.

Figure 4:
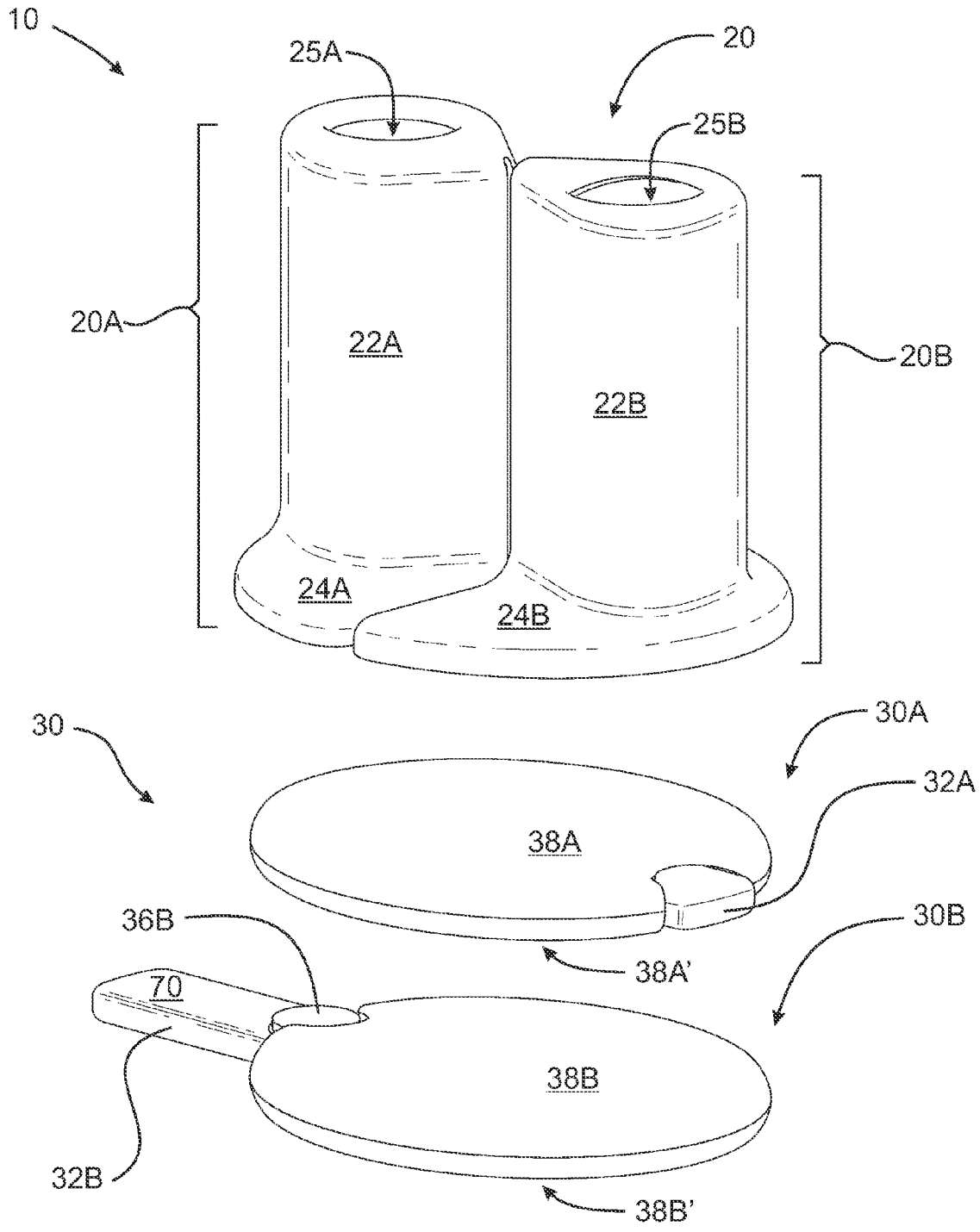
FIG. 4 is a partially-exploded view of the portable ping-pong set, showing the net assembly, the first paddle with the handle retracted, and the second paddle with the handle extended.

FIG. 4 is a partially-exploded view of portable ping-pong set 10, depicting net assembly 20, first paddle 30A and second paddle 30B. First paddle 30A includes first paddle playing surface 38A, first retractable handle 32A, and first locking button 36A (best shown in FIGS. 11 and 13). Second paddle 30B includes second paddle playing surface 38B, second retractable handle 32B, and second locking button 36B. First paddle playing surface 38A and second paddle playing surface 38B have substantially similar thicknesses, diameters, and circumferences. First paddle 30A is shown having first handle 32A fully retracted and second paddle 30B is shown having second handle 32B fully extended. In this view, first and second base members 20A and 20B, when proximate one another, form assembly base 21 that has a first shape having a circumference and a diameter. Similarly, first paddle 30A forms a second shape having a circumference and diameter, which is substantially similar to the first shape. In contrast, second paddle 30B forms a third shape different shape from the first shape and the second shape because second handle 32B is shown fully extended. It should be appreciated that if second handle 32B were shown fully retracted, the third shape would be substantially similar to the first shape and the second shape.

First paddle playing surface 38A includes first upper half 43A and first lower half 43B (not shown). Second paddle playing surface 38B includes second upper half 44A and second lower half 44B (best shown in FIG. 21). First upper half 43A and first lower half 43B of first paddle playing surface 38A are fixedly secured about the circumference of each half such that the two halves form a single paddle. Likewise, second upper half 44A and second lower half 44B of second paddle playing surface 38B are fixedly secured about the circumference of each half such that the two halves form a single paddle. In the preferred embodiment, each paddle is substantially oval-shaped. It should be appreciated that each paddle can be any suitable shape. Additionally, each paddle half includes a substantially flat playing surface, which surface, in a preferred embodiment, is curved along the edge of the blade. The two paddle halves are fixedly secured to one another to form the paddle. It should be appreciated that, in another embodiment, first paddle playing surface 38A and second paddle playing surface 38B can be adjoined along a corrugated perimeter or any other suitable edge.

Figure 12:
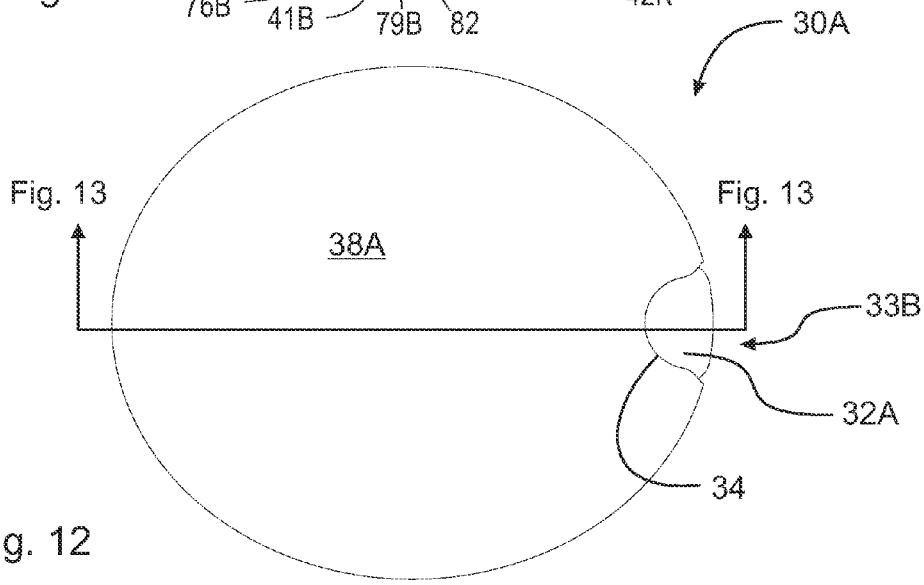
FIG. 12 is a top plan view of the first paddle, depicting the first handle fully retracted.

First upper half 43A and first lower half 43B of first paddle playing surface 38A have substantially U-shaped notches 34A and 34B, respectively (shown in FIG. 21); such that when both halves are mated together, the U-shaped cutouts form first U-shaped aperture 34 (best shown in FIG. 12). When first handle 32A is fully retracted, as shown, within first paddle 30A, first handle end 33B extends slightly beyond first U-shaped aperture 34. Again adverting to FIG. 4, when second handle 32B is fully extended, as shown, second locking button 36B extends slightly beyond the second U-shaped aperture. It should be appreciated that first paddle playing surface 38A and second paddle playing surface 38B could have apertures in a variety of suitable shapes and configurations to accommodate first handle 32A and second handle 32B, respectively.

In a preferred embodiment, first handle 32A and second handle 32B have substantially similar thicknesses, apertures, and locking buttons. However, it should be appreciated that the thicknesses, apertures, and locking buttons could be made in a variety of suitable shapes and dimensions, and could differ from one paddle to another. First handle 32A and second handle 32B both have a length that is approximately twice the width. Additionally, the diameters of the U-shaped apertures are larger than the diameters of the locking buttons.

Figure 5:
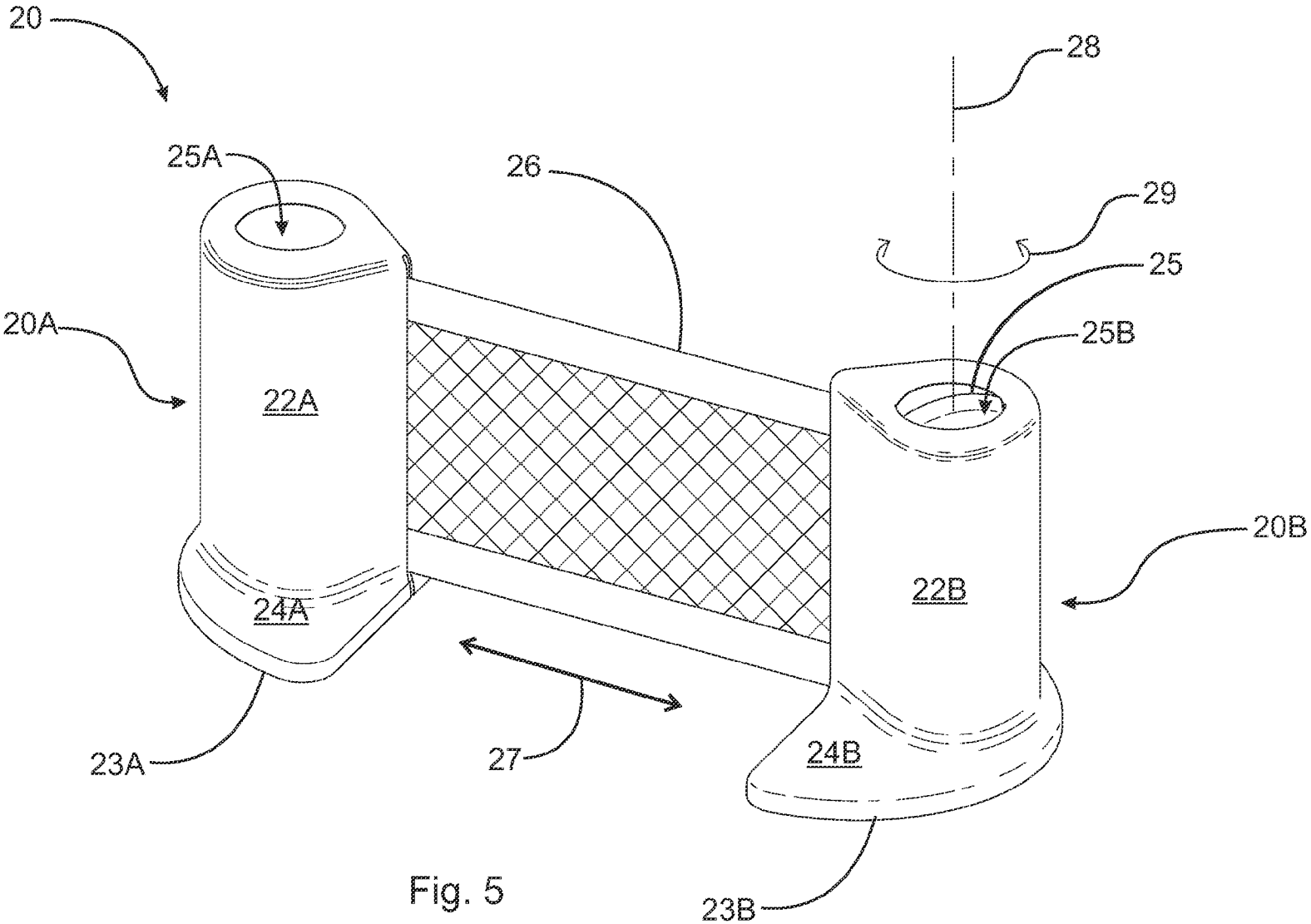
FIG. 5 is a perspective view of the net assembly of the portable ping-pong set, shown with the net partially extended.

FIG. 5 is a perspective view of net assembly 20 of portable ping-pong set 10, shown with the net partially extended. First base member 20A comprises first post 22A, first base member 24A, and first gripping surface 23A (best shown in FIGS. 7A and 9A). Second base member 20B comprises second post 22B, second base member 24B, and second gripping surface 23B (best shown in FIGS. 7A and 9A). First base member 20A and second base member 20B are identical mirror images of each other. First post 22A and second post 22B are integral with and extend upwardly from first base member 24A and second base member 24B, respectively. First post 22A and second post 22B have first height H1 and second height H2, respectively. First height H1 and second height H2 are substantially similar. First post 22A and second post 22B also have first center of gravity CG1 and second center of gravity CG2 (shown in FIGS. 9A and 9B, respectively) disposed within the bottom one-third of the posts, respectively. This low center of gravity of the respective posts provides stability of the posts upon the playing surface. In the preferred embodiment, first post 22A and second post 22B have a substantially cylindrical shape. First base member 24A and second base member 24B are arranged parallel to one another when placed on a flat surface, such as a tabletop. In a preferred embodiment, first base member 24A and second base member 24B are semi-circular in shape and are identical mirror images of each other. It should be appreciated that first base member 24A and second base member 24B can be made in a variety of shapes.

Figure 9A:
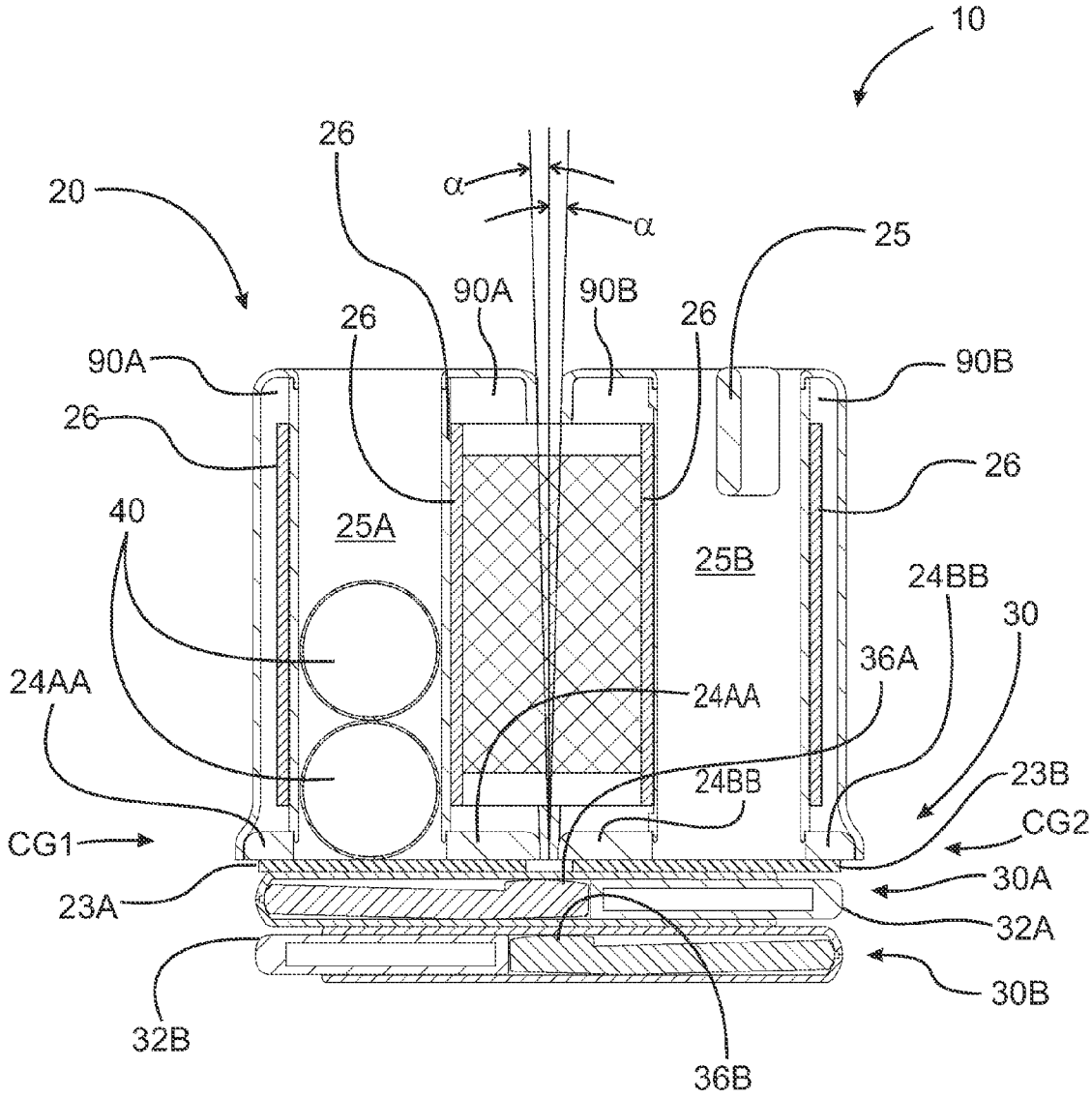
FIG. 9A is a cross-sectional view of the assembly base of the portable ping-pong set shown in FIG. 3, taken generally along line 9A-9A in FIG. 6A.
Figure 9B:
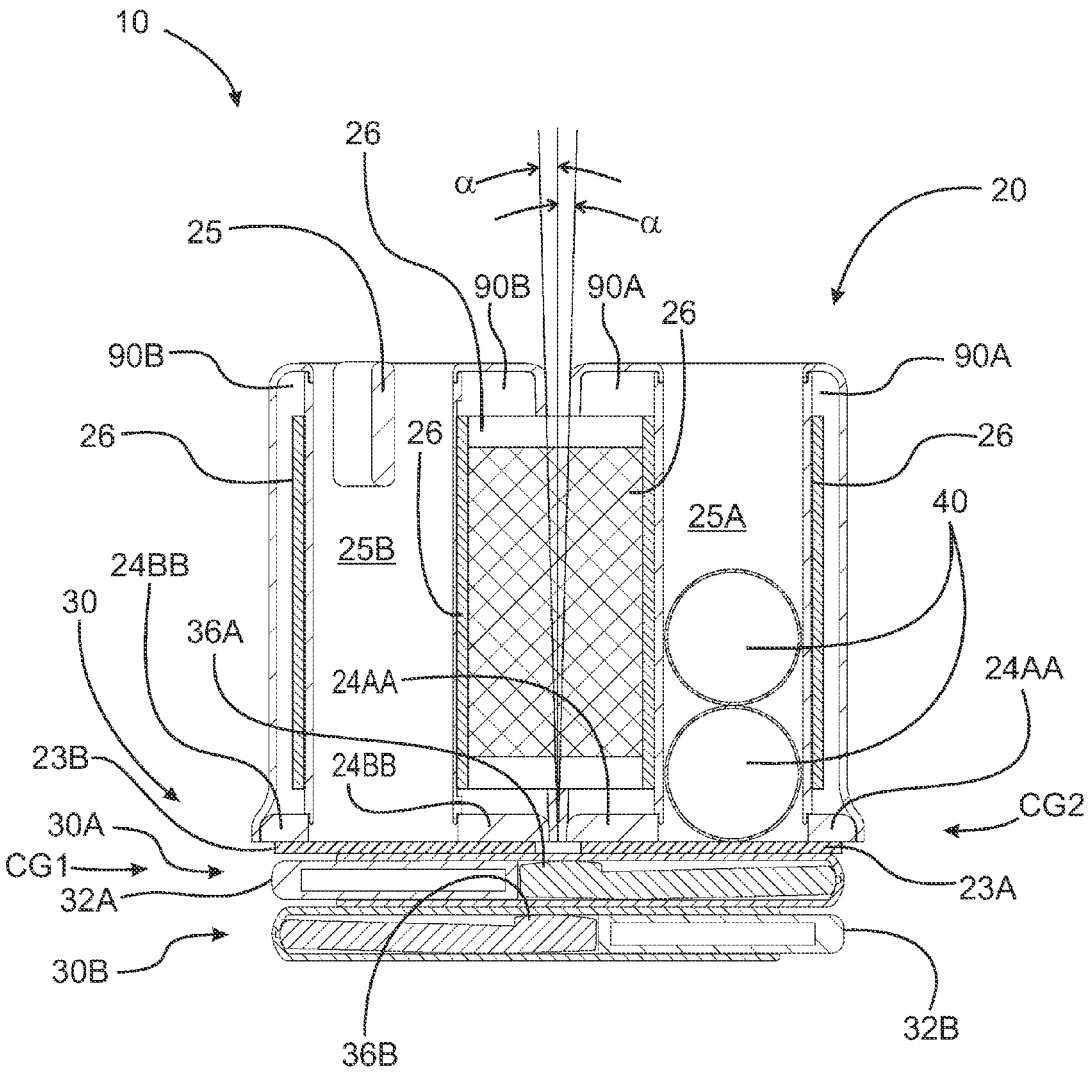
FIG. 9B is a cross-sectional view of the assembly base of the portable ping-pong set shown in FIG. 3, taken generally along line 9B-9B in FIG. 6B.

Net 26 is partially coiled, or retracted, within the second post interior surface 90B (shown in FIGS. 9A and 9B) and fixedly secured to first post interior surface 90A (shown in FIGS. 9A and 9B). Second post further includes 22B net retractor handle 25, which turns about axis of rotation 28 in direction of rotation 29.

Figure 6A:
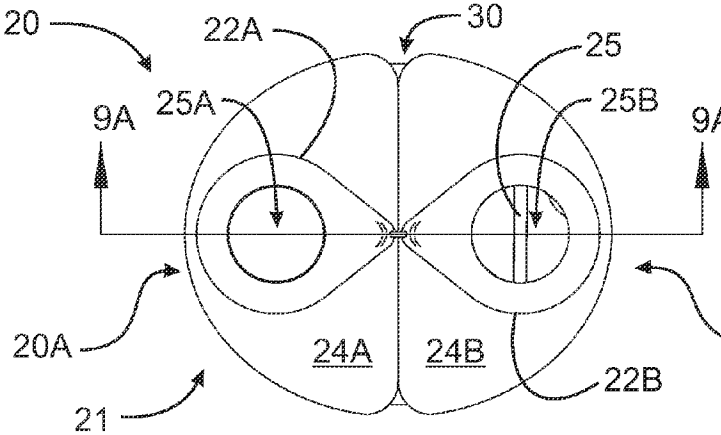
FIG. 6A is a top plan view of the assembly base of the portable ping-pong set shown in FIG. 3.

FIG. 6A is a top plan view of assembly base 21 of portable ping-pong set 10 shown in FIG. 3, depicting first post 22A and first base member 24A facing rightward and second post 22B and second base member 24B facing leftward. When first base member 20A and second base member 20B are adjacent to one another, first base member 24A and second base member 24B abut each other along their straight edges. First post 22A and second post 22B are proximate each other along their inward-facing edges containing their vertical passageways. Net 26 connects first post 22A and second post 22B between their vertical passageways. Within second post 22B, net retractor handle 25 is shown operatively arranged to coil net 26 around the inside of net storage column 22B. Paddle pair 30 is shown stacked underneath first assembly base 20A and second assembly base 20B. In this view, it should be appreciated that paddle pair 30 is arranged so that first and second retractable handles 32A and 32B are fully retracted. As shown, the circumference and diameter of first and second base members 20A and 20B when in contact with one another, is larger than the circumference and diameter of paddle pair 30 when stacked atop one another. Similarly, the circumference and diameter of first and second base members 20A and 20B when in contact with one another, is substantially similar to the circumference and diameter of paddle pair 30. As stated above, it should be appreciated that first and second base members 20A and 20B when in contact with one another, and paddle pair 30 can be made to form other shapes, such as a box.

Figure 7A:
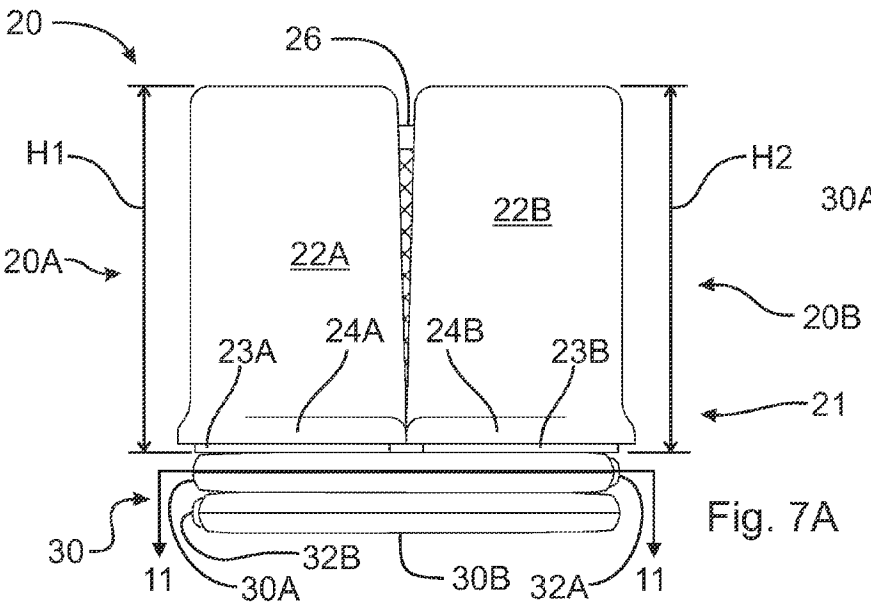
FIG. 7A is a front elevational view of the assembly base of the portable ping-pong set shown in FIG. 3, showing the first post and the first base member on the left, and the second post and the second base member on the right.

FIG. 7A is a front elevational view of assembly base 21 of portable ping-pong set 10 shown in FIG. 3, showing first post 22A and first base member 24A facing rightward and second post 22B and the second base member 24B facing leftward. From this view, first and second gripping surfaces 23A and 23B are visible underneath first and second base members 20A and 20B. The first shape formed by first and second base members 20A and 20B is larger in diameter than the diameter of paddle pair 30. Also, it is shown that first and second base members 20A and 20B contact each other at point X which is the vertex of angle Y. In this view, the inward-facing edges of first and second base members 20A and 20B become farther apart from one another along the line segments of angle Y. The inward-facing edges are farthest apart at the tallest heights of first and second posts 22A and 22B. Net 26 passes between first and second posts 22A and 22B through their vertical passageways along the line segments of angle Y.

Figure 8A:
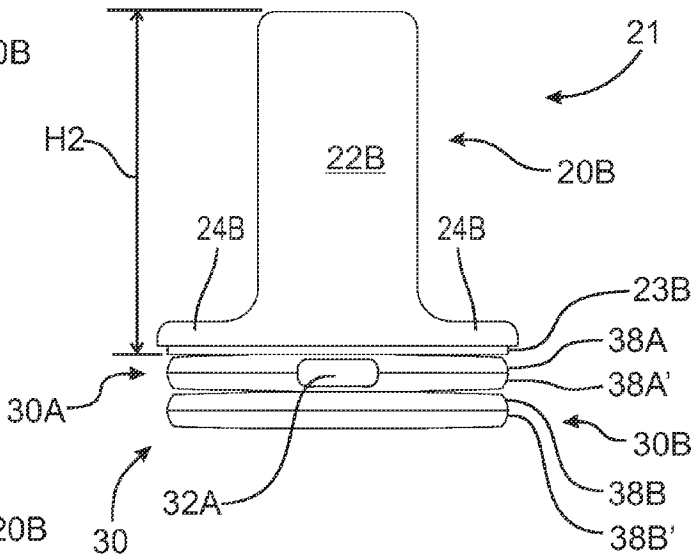
FIG. 8A is a right side elevational view of the assembly base of the portable ping-pong set shown in FIG. 3, where the first and second posts and the first and second base members are proximate one another and resting atop two paddles.

FIG. 8A is a right side elevational view of assembly base 21 of portable ping-pong set 10 shown in FIG. 3, where first post 22A and second post 22B and first base member 24A and second base member 24B are proximate one another and resting atop paddle pair 30. In this embodiment, first and second base members 20A and 20B are arranged in an inverted "T" shape where the widths of first and second posts 22A and 22B are less than the widths of first and second base members 24A and 24B. The widths of first and second posts 22A and 22B are less than the widths of first and second base members 24A and 24B because this arrangement allows a user to easily grab each column and pull them apart. It should be appreciated that in another embodiment the widths of first and second posts 22A and 22B could be equal to or greater than the widths of first and second base members 24A and 24B. Second base member 20B hides first base member 20A because they are identical in shape and mirror images of each other. It should also be appreciated that first and second base members 20A and 20B do not need to be identical and mirror images of each other. This stacking arrangement minimizes volume of the assembly for packaging and shipping.

Figures 6B, 7B, 8B:
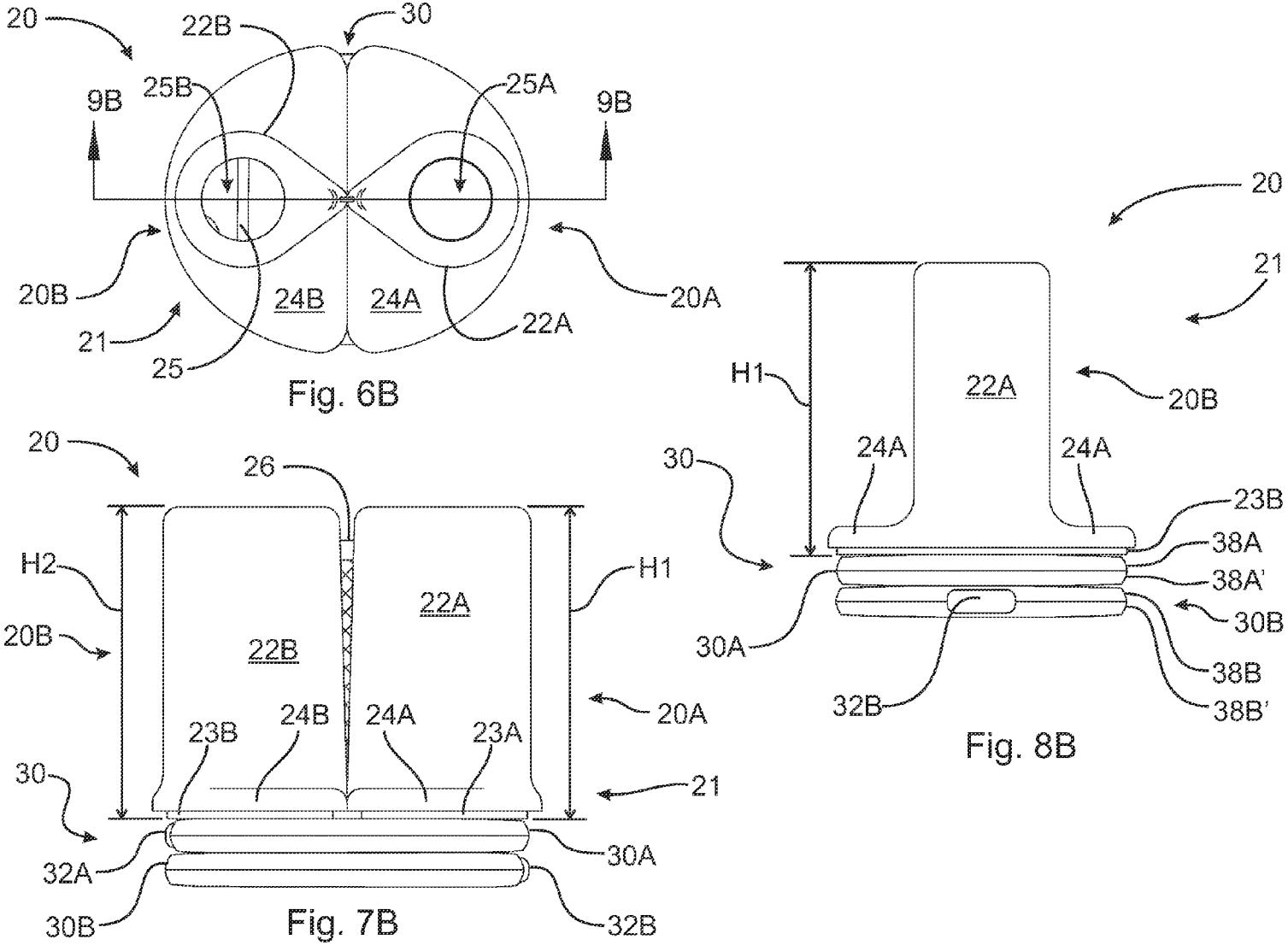
FIG. 6B is a top plan view of the assembly base of the portable ping-pong set shown in FIG. 3, but with the entire assembly rotated 180°.
FIG. 7B is a front elevational view of the assembly base of the portable ping-pong set shown in FIG. 3, showing the first post and the first base member on the right and the second post and the second base member on the left.
FIG. 8B is a left side elevational view of the assembly base of the portable ping-pong set shown in FIG. 3, where the first and second posts and the first and second base members are proximate one another and resting atop two paddles.

FIG. 6B is a top plan view of assembly base 21 of portable ping-pong set 10 shown in FIG. 3, illustrating first post 22A and first base member 24A facing leftward and second post 22B and second base member 24B facing rightward. FIG. 6B is the opposite side of the view shown in FIG. 6A.

FIG. 7B is a front elevational view of assembly base 21 of portable ping-pong set 10 shown in FIG. 3, showing first post 22A and first base member 24A facing leftward and second post 22A and second base member 24B facing rightward. FIG. 7B is the opposite side of the view shown in FIG. 7A.

FIG. 8B is a left side elevational view of assembly base 21 of portable ping-pong set 10 shown in FIG. 3, where first post 22A and second post 22B and first base member 24A and second base member 24B are proximate one another and resting atop paddle pair 30. FIG. 8B is the opposite side of the view shown in FIG. 8A.

FIG. 9A is a cross-sectional view of assembly base 21 of portable ping-pong set 10 shown in FIG. 3, taken generally along line 9A-9A in FIG. 6A. Assembly base 21 comprises first partial through-bore 25A operatively arranged to house ball pair 40, second partial through-bore 25B operatively arranged to house net retractor handle 25, a plurality of weights 24AA and 24BB along the bottom of first and second base members 20A and 20B, net 26 operatively arranged around and between first and second partial through-bores 25A and 25B, and first and second gripping surfaces 23A and 23B located underneath first and second base members 20A and 20B. First and second partial through-bores 25A and 25B have substantially similar heights and widths. First partial through-bore 25A has an inner width that is substantially similar to the width of ball pair 40. Second partial through-bore 25B has an inner width that is substantially similar to the width of net retractor handle 25 (not shown).

Net 26 has a height that is less than the heights of first and second partial through-bores 25A and 25B. Since the height of net 26 is less than the heights of first and second partial through-bores 25A and 25B net 26 has room to move vertically. Since first and second base members 20A and 20B are manually separated and manually coiled using net retractor handle 25 it is likely first and second base members 20A and 20B will not be upright at all times. Instead, when first and second base members 20A and 20B are manually separated and manually coiled using net retractor handle 25 it is likely first and second base members 20A and 20B, or one without the other, will tilt inwards or outwards. If there was no room for net 26 to slide upwards or downwards along first and second partial through-bores 25A and 25B, net 26 could tear or otherwise become damaged.

Plurality of weights 24AA and 24BB are operatively arranged around first and second partial through-bores 25A and 25B. Moreover, it is clear, in a preferred embodiment, plurality of weights 24AA and 24BB have heights that are equal to or less than the heights of first and second base members 24A and 24B. The heights of plurality of weights 24AA and 24BB are such that they do not interfere with net 26. These weights function to lower the centers of gravity of the respective posts.

The cross-sectional view of paddle pair 30 in FIG. 9 shows first and second retractable handles 32A and 32B and first and second locking buttons 36A and 36B. When paddle pair 30 is in a stacked formation, the first and second locking buttons are substantially aligned.

FIG. 9B is a cross-sectional view assembly base 21 of portable ping-pong set 10 shown in FIG. 3, taken generally along line 9B-9B in FIG. 6B. FIG. 9B is the opposite side of the view shown in FIG. 9A.

FIG. 10A is a top plan view of portable ping-pong set 10 shown in FIG. 3. W1 depicts the width of the diameter of both first base member 24A and second base member 24B, which are substantially the same. L1 depicts the length of first base member 24A and second base member 24B when first base member 24A and second base member 24B are adjacent to one another, along the longest edge of base assembly 21. In a preferred embodiment, W1 is approximately 15.5 cm and L1 is approximately 19 cm. When first base member 24A and second base member 24B rest atop paddle pair 30 (not shown), first base member 24A and second base member 24B extend slightly beyond the circumference of paddle pair 30.

FIG. 10B is a bottom plan view of portable ping-pong set 10 shown in FIG. 3. W2 depicts the width of a first diameter of first paddle 30A and second paddle 30B, which are substantially the same. L2 depicts the length of a second diameter of first paddle 30A and second paddle 30B, which are substantially the same. In a preferred embodiment, W2 is approximately 15 cm and L2 is approximately 17.5 cm. When first base member 24A (shown in FIG. 3) and second base member 24B (shown in FIG. 3) rest atop paddle pair 30, it should be appreciated that W2 and L2 are slightly smaller than W1 and L1, respectively.

Figure 11:
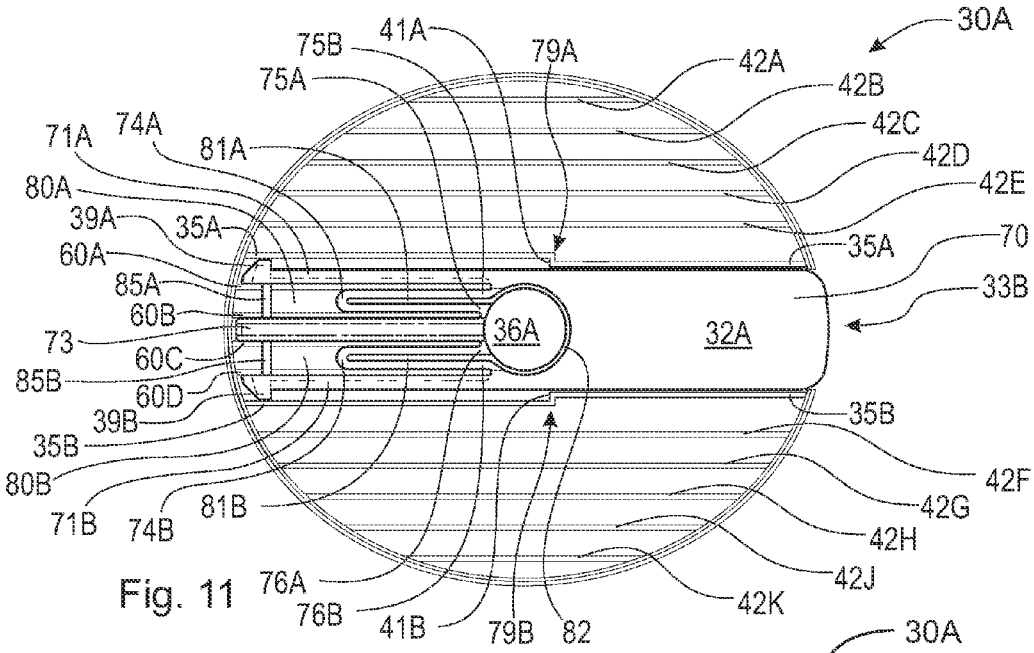
FIG. 11 is a cross-sectional view of the first paddle taken generally along line 11-11 in FIG. 7A, showing the first handle fully retracted.

FIG. 11 is a cross-sectional view of first paddle 30A taken generally along line 11-11 in FIG. 7A, showing first handle 32A fully retracted. FIG. 11 is similar to the view shown in FIG. 14B where first handle 32A is fully extended, except, in FIG. 11, first handle 32A is shown fully retracted. Illustrated here, first paddle 30A comprises plurality of support beams 42A, 42B, 42C, 42D, 42E, 42F, 42G, 42H, 42J, and 42K which extend across the inside of first paddle 30A between the leftward side of first paddle 30A and the rightward side of first paddle 30A. Each support beam is straight and each support beam is parallel to one another. Each support beam is fixedly secured to first paddle 30A. First paddle 30A further comprises first outer alignment member 35A, second outer alignment member 35B, and first retractable handle 32A.

First outer alignment member 35A is similar to plurality of support beams 42A, 42B, 42C, 42D, 42E, 42F, 42G, 42H, 42J, and 42K which extend across the inside of first paddle 30A except it further comprises first outer prong abutment shoulder 79A and first shoulder surface 41A. First outer prong abutment shoulder 79A divides first outer alignment member 35A into two straight and parallel segments and separates the two straight and parallel segments of first outer alignment member 35A a distance equal to the height of first outer prong abutment shoulder 79A so that the leftmost segment is not continuous with the rightmost segment. First outer prong abutment shoulder 79A functions to stop first prong end 39A from further slidingly engaging with first paddle 30A along first outer alignment member 35A. In other words, when a user pulls first retractable handle 32A rightwardly, first outer prong abutment shoulder 79A provides a stopping point so that a user cannot pull first handle 32A out from within first paddle 30A. First prong end 39A abuts first outer prong abutment shoulder 79A along first shoulder surface 41A as shown in FIG. 14B. Second outer alignment member 35B is the mirror image of first outer alignment member 35A and comprises second outer prong abutment shoulder 79B. Furthermore, second outer alignment member 35B serves the same functions as first outer alignment member 35A supporting first handle 32A as it slidably engages first paddle 30A and providing a maximum extension point for first handle 32A. When a user fully extends first handle 32A, second prong end abuts second outer prong abutment shoulder 79B along second shoulder surface 41B. As shown, first prong end 33A is positioned along the leftward side of first paddle 30A since first handle 32A is fully retracted. First prong end 33A slidably engages first outer alignment member 35A, plurality of channels 62, 63, 64, 65, and 66, plurality of baffles 60A, 60B, 60C and 60D, and second outer alignment member 35B as first handle 32A extends and retracts.

As shown in FIG. 11, first handle 32A comprises handle body 70, first locking button 36A, first outer prong 71A, first prong end 39A, first looped member 74A, center prong 73, second looped member 74B, second prong end 39B, and second outer prong 71B. It should be appreciated that first handle 32A is identical in FIG. 14B. Top cross brace 85A is fixedly secured to and between first outer prong 71A and center prong 73. Similarly, bottom cross brace 85B is fixedly secured to and between second outer prong 71B and center prong 73. Both top and bottom cross braces 85A and 85B serve to support the parallel arrangement between first outer prong 71A, center prong 73, and second outer prong 71B. As shown, when first handle 32A is fully retracted, first outer prong 71A rests between first outer alignment member 35A and baffle 60A. The distance between first outer alignment member 35A and baffle 60A is substantially equal to the height of first prong end 39A. First looped member 74A rests between baffle 60A and baffle 60B. The distance between baffle 60A and baffle 60B is substantially equal to the width of first looped member 74A. Center prong 73 rests between baffle 60B and baffle 60C. The distance between baffle 60B and baffle 60C is substantially equal to the width of center prong 73. Second looped member 74B rests between 60C and baffle 60D. The distance between baffles 60C and 60D is substantially equal to the width of second looped member 74B. Second outer prong 71B rests between baffle 60D and second outer alignment member 35B. The distance between baffle 60D and second outer alignment member 35B is substantially similar to the height of second prong end 39B. As shown, when first handle 32A is fully retracted, first locking button 36A is positioned along the center of first paddle 30A. Similarly, handle body 70 is positioned along the right side of first paddle 30A.

FIG. 12 is a top plan view of first paddle 30A, depicting first handle 32A fully retracted. First handle 32A, when fully retracted is flush with the edge of first paddle playing surface 38A. First handle end 33B protrudes beyond first U-shaped aperture 34 in order for a user to grasp first handle end 33B and extend first handle 32A.

Figure 13:
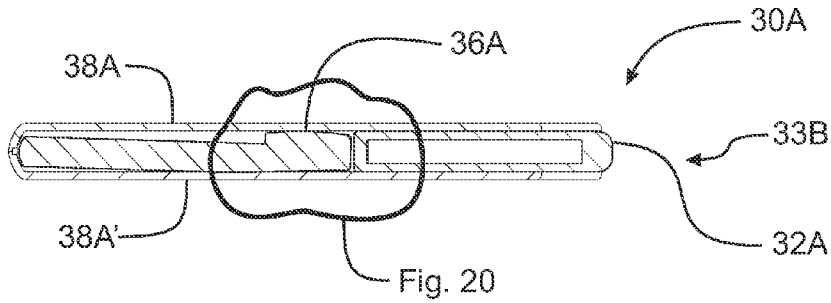
FIG. 13 is a cross-sectional view of the first paddle taken generally along line 13-13 in FIG. 12.

FIG. 13 is a cross-sectional view of first paddle 30A taken generally along line 13-13 in FIG. 12. First locking button 36A is shown housed within first paddle 32A when first handle 32A is fully retracted. First locking button 36A is angled slightly upward, such that it presses against the interior surface of first paddle playing surface 38A.

Figure 14A:
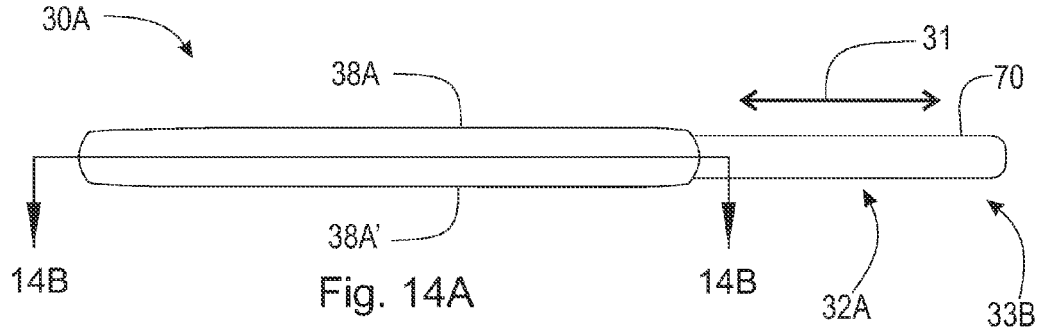
FIG. 14A is a front elevational view of the first paddle, illustrating the first handle fully extended.
Figure 14B:
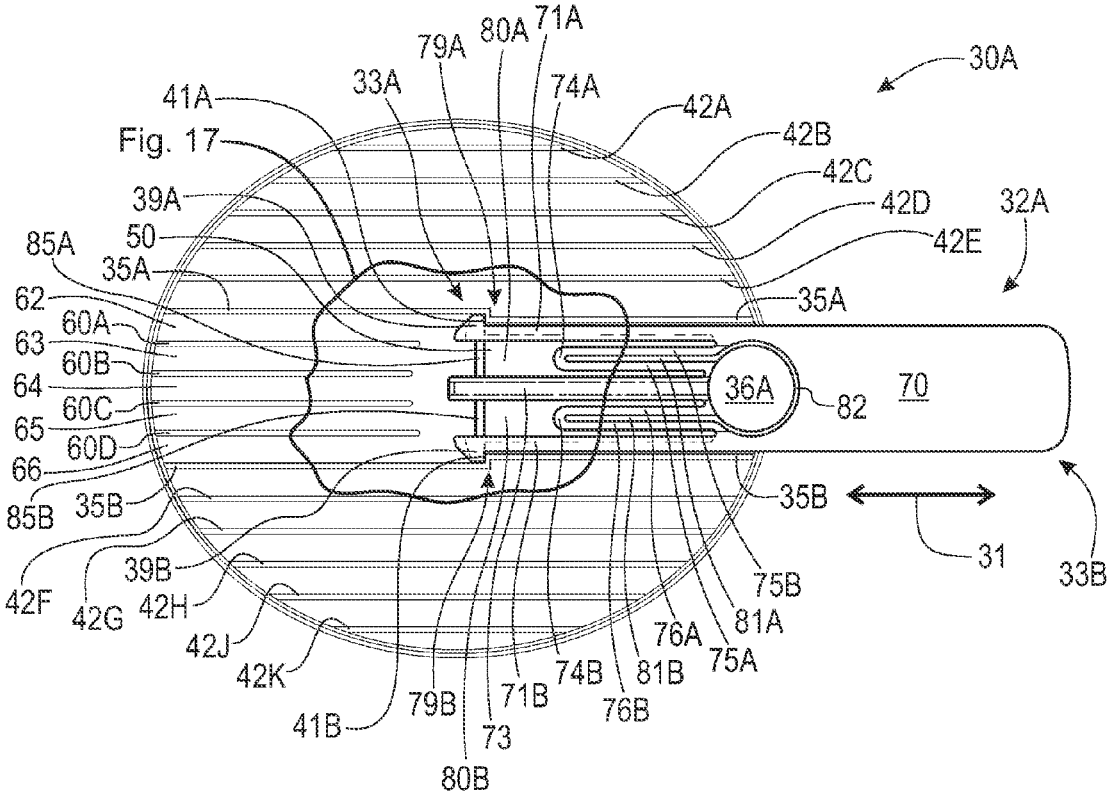
FIG. 14B is a cross-sectional view of the first paddle taken generally along line 14B-14B in FIG. 14A, showing the first handle fully extended.

FIG. 14A is a front elevational view of first paddle 30A, illustrating first handle 32A fully extended. Handle retraction direction 31 illustrates that first handle 32A retracts backwards into first paddle 30A and extends forward beyond first U-shaped aperture 34 (not shown) into a locked position. Handle retraction direction 31 moves in two directions, forwards and backwards, and those two directions are 180 degrees opposite one another. When fully extended, first handle body 70 is visible.

FIG. 14B is a cross-sectional view of first paddle 30A taken generally along line 14B-14B in FIG. 14A, showing the first handle 32A fully extended. FIG. 14B is similar to the view shown in FIG. 11, except first handle 32A is fully extended, whereas in FIG. 11, first handle 32A is fully retracted. As shown, first prong end 33A is positioned in the center of first paddle 30A, when first handle 32A is fully extended. First prong end 33A slidably engages channels 62, 63, 64, 65, and 66 as first handle 32A extends and retracts.

Figure 15:
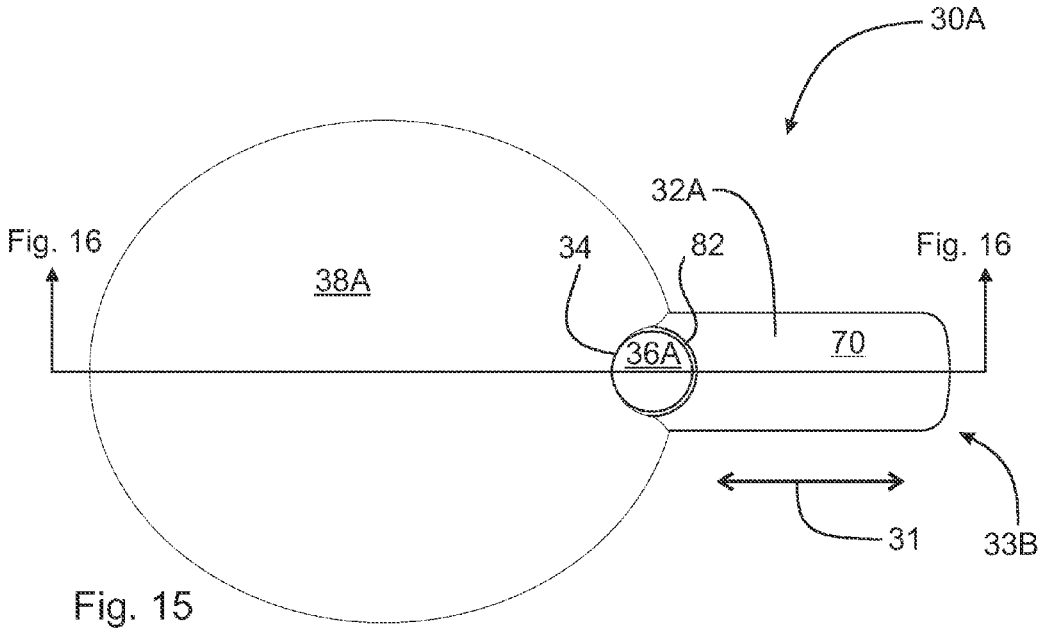
FIG. 15 is a top plan view of the first paddle, showing the first handle fully extended.

FIG. 15 is a top plan view of first paddle 30A, showing first handle 32A fully extended. FIG. 15 is similar to the view shown in FIG. 12, except first handle 32A is fully extended, whereas in FIG. 12, first handle 32A is fully retracted. Locking button 36A is shown raised and locked into place within first U-shaped aperture 34. Button aperture 82 surrounds approximately half of locking button 36A and allows locking button 36A flexibility to be raised or depressed depending on whether first handle 32A is extended or retracted.

Figure 16:
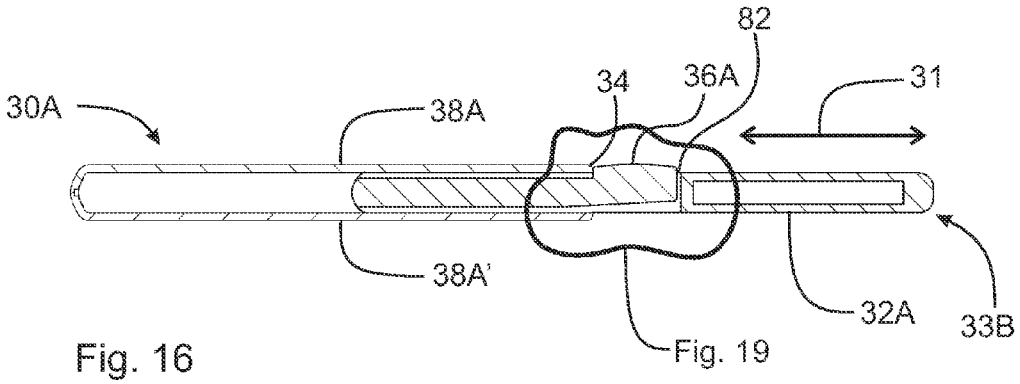
FIG. 16 is a cross-sectional view of the first paddle taken generally along line 16-16 in FIG. 15.

FIG. 16 is a cross-sectional view of first paddle 30A taken generally along line 16-16 in FIG. 15. In this perspective a user has manually pulled first retractable handle 32A (at first handle outer end 33B) rightwardly along direction 31. When a user pulls first retractable handle 32A to the extent shown here, first locking button 36A is naturally forced upward. First locking button 36A is shown next to first cut out 34. When first locking button 36A is in its most upward position button aperture 82 is largest.

Figure 17:
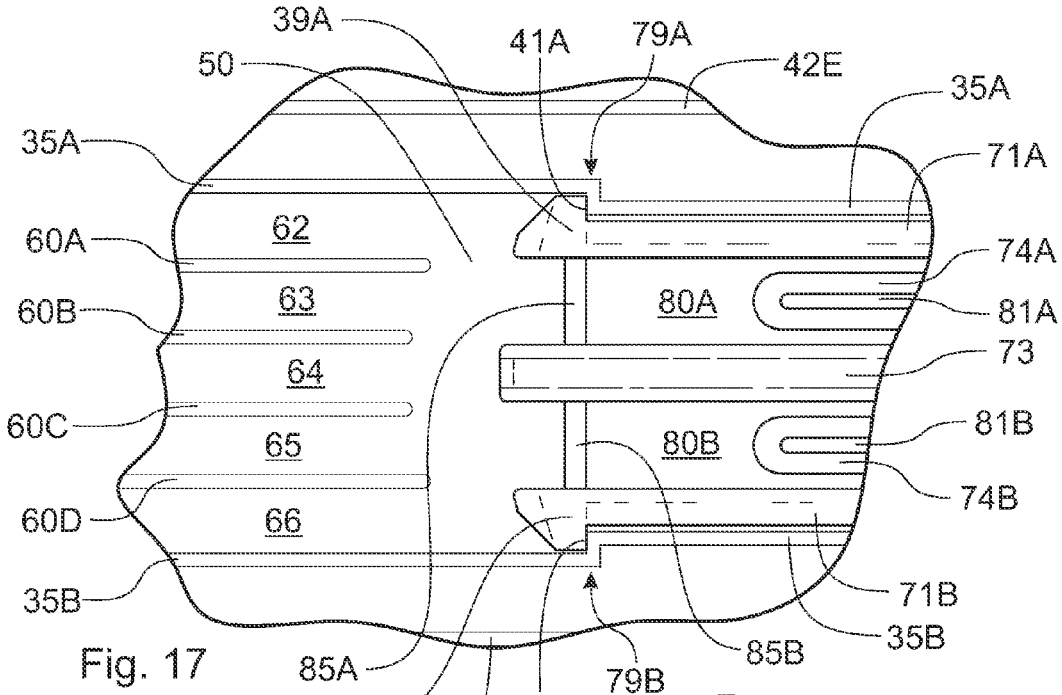
FIG. 17 is a detailed view of the first prong end of the first handle shown in area 17 in FIG. 14, depicting the first handle fully extended.

FIG. 17 is a detailed view of first handle inner end 33A of first handle 32A shown in area 17 in FIG. 14, depicting first handle 32A fully extended. Here, first outer alignment member 35A surrounds first outer prong 71A and second outer alignment member 35B surrounds second outer prong 71B. First prong end 39A is shown abutting first shoulder surface 41A of first outer prong abutment shoulder 79A. Similarly, second prong end 39B is abutting second shoulder surface 41B of second outer prong abutment shoulder 79B. When first retractable handle 32A is in this extended position, narrow channels 62, 63, 64, 65, and 66 are empty. In this arrangement, first outer prong 71A, first looped member 74A, center prong 73, second looped member 74B, and second outer prong 71B fit between first inner straight segment 51A of first alignment member 35A and second inner straight segment 51B of second alignment member 35B.

Figure 18A:
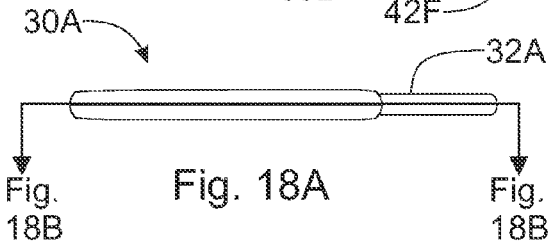
FIG. 18A is a front elevational view of the first paddle, illustrating the first handle partially extended.

FIG. 18A is a front elevational view of first paddle 30A, illustrating the first handle 32A partially extended. Here, it is clearly shown that first top paddle playing surface 38A and first bottom paddle playing surface 38A' are planar and smooth. Similarly, it is clearly shown that handle body 70 of first retractable handle 32A is planar and smooth. From this view first locking button 36A is not visible because it is between first top paddle playing surface 38A and first bottom paddle playing surface 38A'.

Figure 18B:
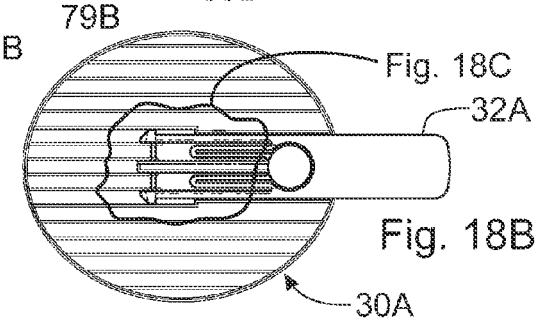
FIG. 18B is a cross-sectional view of the first paddle taken generally along line 18B-18B in FIG. 18A, showing the first handle partially extended.

FIG. 18B is a cross-sectional view of first paddle 30A taken generally along line 18B-18B in FIG. 18A, showing the first retractable handle 32A partially extended. Here, a user has pulled first retractable handle 32A rightwardly, but not to the fullest extent. First outer prong 71A is shown aligned between first outer alignment member 35A and baffle 60A. More specifically, first prong end 39A of first outer prong 71A is shown between second outer straight segment 52A of first outer alignment member 35A and baffle 60A. It should be appreciated that first prong end 39A has a width substantially similar to the width of narrow channel 62 which sits between first outer prong 71A and baffle 60A. Center prong 73 is shown aligned between baffle 60B and baffle 60C within narrow channel 64. Second outer prong 71B is shown aligned between baffle 60D and second outer alignment member 35B. More specifically, second prong end 39B of second outer prong 71B is shown between baffle 60D and second outer straight segment 52B of second outer alignment member 35B. The width of second prong end 39B is substantially similar to the width of narrow channel 66. Similarly, it should be appreciated that the width of center prong 73 is substantially similar to the width of narrow channel 64. From this view, first locking button 36A is visible only because first top paddle playing surface 38A has been removed. If first top paddle playing surface 38A was in place first locking button 36A would be invisible between first top paddle playing surface 38A and first bottom paddle playing surface 38A'.

Figure 18C:
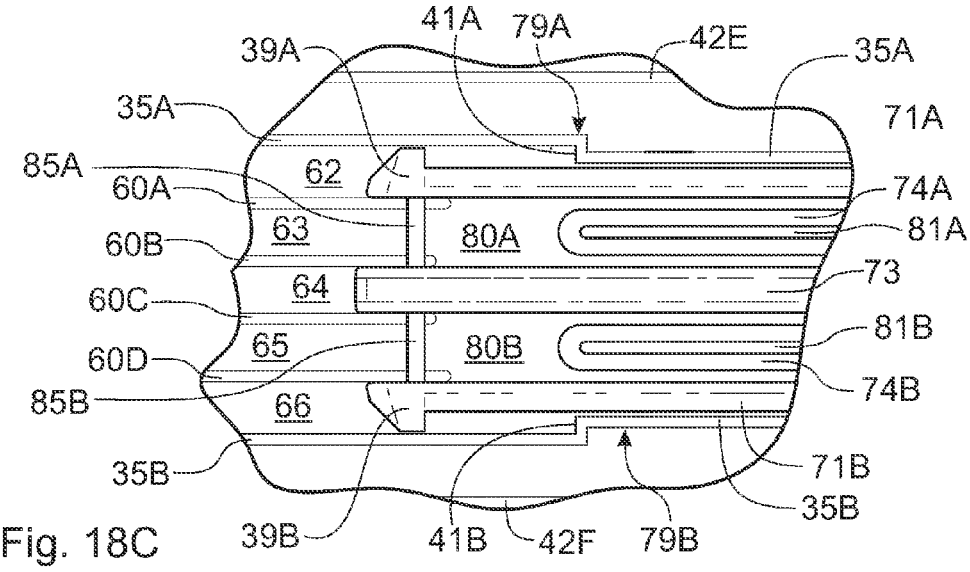
FIG. 18C is a detailed view of the first prong end of the first handle shown in area 18C in FIG. 18B, depicting the first handle partially extended.

FIG. 18C is a detailed view of first handle end 33A of first handle 32A shown in area 18C in FIG. 18B, depicting first handle 32A partially extended. As just described first outer alignment member 35A and second outer alignment member 35B enclose first handle end 33A of first retractable handle 32A. First outer prong 71A is shown slidingly engaging with narrow channel 62 between first outer alignment member 35A and baffle 60A. Since first retractable handle 32A is partially extended, first prong end 39A is free to slide leftwardly or rightwardly with the rest of first retractable handle 32A. Center prong 73 is shown slidingly engaging with narrow channel 64 between baffle 60B and baffle 60C. As previously described, the width of center prong 73 is substantially similar to the width of narrow channel 64. Similarly, the width of first prong end 39A is substantially similar to the width of narrow channel 62 and the width of second prong end 39B is substantially similar to the width of narrow channel 66. First cross-brace 85A is shown fixedly secured between first prong end 39A and center prong 73 and on top of baffle 60A and baffle 60B. Therefore, it should be appreciated that the height of baffle 60A and the height of baffle 60B are less than the height of first prong end 39A and the height of center prong 73. First looped member 74A is shown between first outer prong 71A and center prong 73 next to first prong space 80A. It should be appreciated that first looped member 74A is operatively arranged to slidingly engage leftwardly through first prong space 80A and narrow channel 63. First looped member 74A is also operatively arranged to slidingly engage rightwardly through first prong space 80A. Second looped member 74B is shown between center prong 73 and second outer prong 71B next to second prong space 80B. Like first looped member 74A, second looped member 74B is operatively arranged to slidingly engage leftwardly through second prong space 80B and narrow channel 65. Second looped member 74B is also operatively arranged to slidingly engage rightwardly through second prong space 80B. The width of first looped member 74A is substantially similar to the width of narrow channel 63. The width of second looped member 74B is substantially similar to the width of narrow channel 65. Similar to first cross-brace 85A, second cross-brace 85B is shown fixedly secured to second prong end 39B and center prong 73 and over baffle 60C and baffle 60D. Hence, the height of baffle 60C and the height of baffle 60D are less than the height of second prong end 39B and the height of center prong 73. Moreover, it should be appreciated that the length of baffle 60B and the length of baffle 60C are substantially similar. The length of baffle 60A and the length of baffle 60C are substantially similar.

Figure 19:
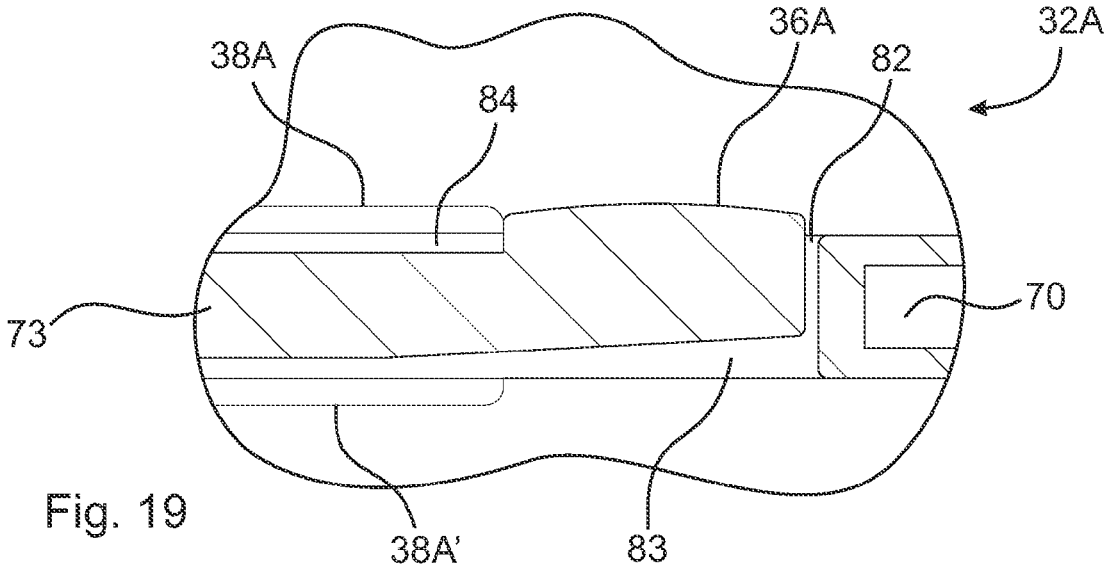
FIG. 19 is a detailed view of the first locking button shown in area 19 in FIG. 16, illustrating the first locking button when the first handle is fully extended.

FIG. 19 is a detailed view of first locking button 36A shown in area 19 in FIG. 16, illustrating first locking button 36A when first handle 32A is fully extended. This cross-sectional view depicts from left to right center prong 73, first locking button 36A, and first handle body 70. These components are shown protruding from between first top paddle playing surface 38A and first bottom paddle playing surface 38A'. Surrounding first locking button 36A, this view shows button aperture 82, button compression space 83, and button extension space 84. When a user pulls handle body 70 of first retractable handle 32A rightwardly to the fullest extent, first locking button 36A naturally protrudes upward. This natural upward protrusion is due to a constant upward pressure coming from a springing mechanism within the connectivity of first looped member 74A and second looped member 74B to center prong 73. In order to allow first locking button 36A to protrude upward, in between first top paddle playing surface 38A and first bottom paddle playing surface 38A', there is button compression space 83 and button extension space 84. Additionally, on the right-hand side of first locking button 36A and next to first handle body 70, the present invention comprises button aperture space 82. As discussed above, when first retractable handle 32A is fully extended, button aperture space 82 is largest. In this position, button extension space 84 is smallest. In contrast, in this position button compression space 83 is largest. Button compression space 83 is largest because button compression space 83 is necessary to allow first locking button 36A to move downward when a user presses first locking button 36A. Similarly, button extension space 84 is necessary to allow first locking button 36A to move upward when a user pulls first retractable handle 32A into its fully extended position. When first retractable handle 32A is in its fully extended position, button extension space 84 is smallest because first locking button 36A is in its most upward position. This figure also shows that first locking button 36A is next to first top paddle playing surface 38A when first retractable handle 32A is fully extended.

Figure 20:
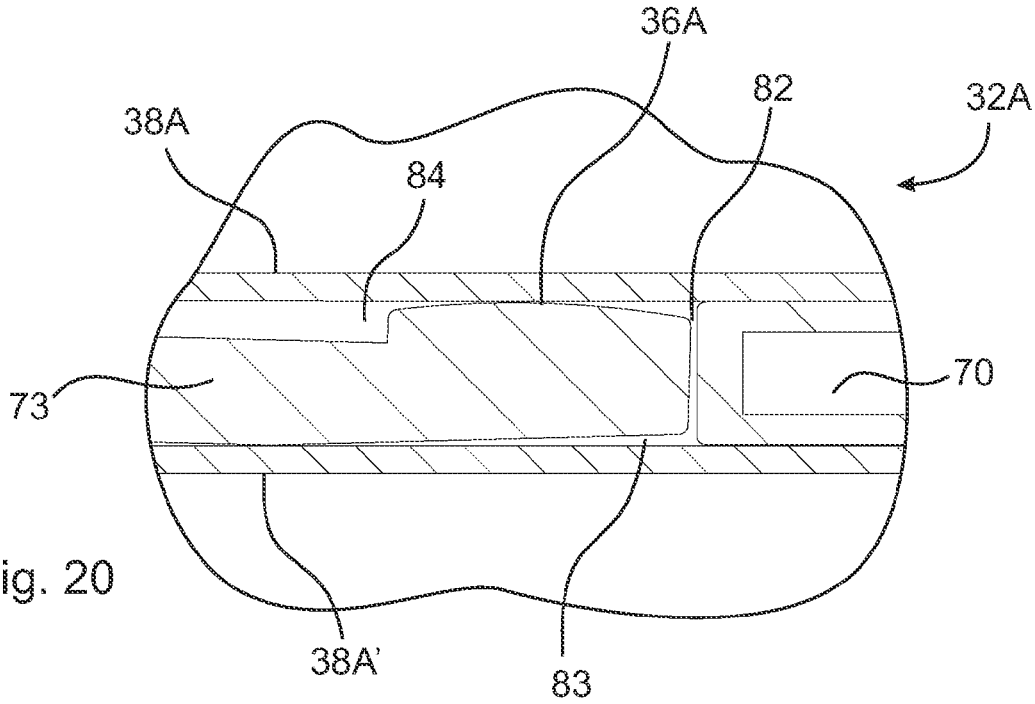
FIG. 20 is a detailed view of the first locking button shown in area 20 in FIG. 13, depicting the first locking button when the first handle is fully retracted; and, FIG. 21 is an exploded view of the first paddle.

FIG. 20 is a detailed view of first locking button 36A shown in area 20 in FIG. 13, depicting first locking button 36A when first handle 32A is fully retracted. This cross-sectional also view depicts from left to right center prong 73, first locking button 36A, and first handle body 70 between first top paddle playing surface 38A, and first bottom paddle playing surface 38A'. Also, this view illustrates button aperture 82, button compression space 83, and button extension space 84 surrounding first locking button 36A. In contrast to FIG. 19, first locking button 36A is under first top paddle playing surface 38A rather than next to it. To retract first retractable handle 32A, a user depresses first locking button 36A within button compression space 83 and pushes first retractable handle 32A leftwardly. Since a user depresses first locking button 36A into button compression space 83, button compression space 83 decreases in size as first locking button descends. When first retractable handle 32A is fully retracted, button compression space 83 is smallest. Similarly, when a user depresses first locking button 36A, button aperture 82 also decreases in size. Button extension space 84 increases in size because first locking button is pushed downward.

Figure 21:
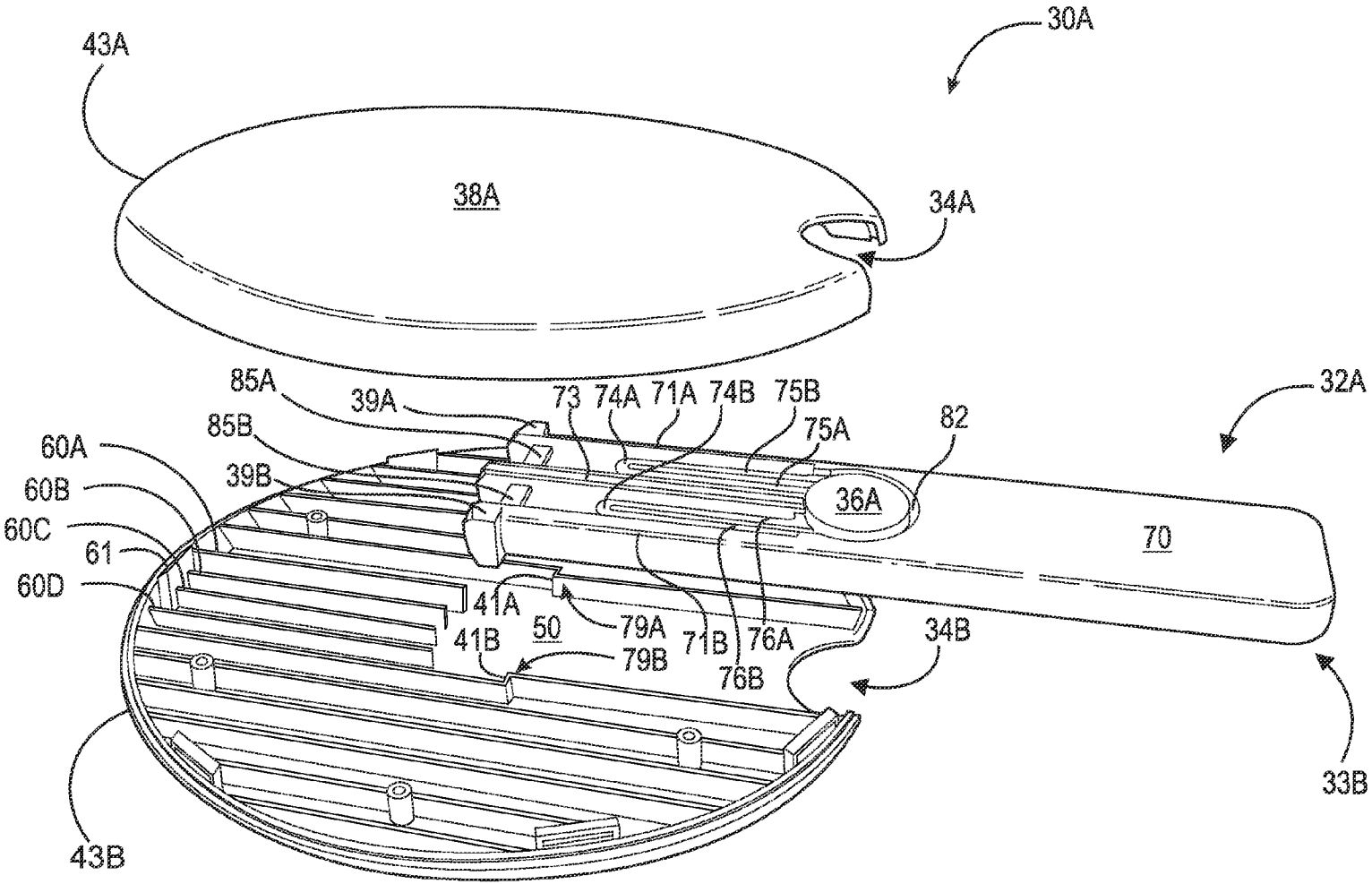

FIG. 21 is a partial exploded view of first paddle 30A. First paddle 30A comprises first top paddle surface 38A, first bottom paddle surface 38A', and first retractable handle 32A. First top paddle surface 38A is planar, smooth, and fixedly secured to first top sloping segment 43A. First top sloping segment 43A extends along a curve from the exterior of first top paddle surface 38A in a downward and outward manner toward first bottom paddle surface 38A'. First top paddle surface 38A and first top sloping segment are shown having first top cut out 34 which comprises a rounded aperture. First top cut out 34 is semi-circular in shape and accommodates first locking button 36A. It should be appreciated that first top cut out 34 could be any shape so long as it accommodates, meaning it is at least as large as the locking portion of first locking button 36A.

First bottom paddle surface 38A' (not shown) mirrors first top paddle surface 38A and is planar, smooth, and fixedly secured to first bottom sloping segment 43B. First bottom sloping segment 43B extends along a curve from the exterior of first bottom paddle surface 38A' (not shown) in an upward and outward manner toward first top paddle surface 38A. First bottom cut out 34' mirrors first top cut out 34. First bottom cut out 34' is a rounded aperture and semi-circular in shape. First bottom cut out 34' accommodates first locking button 36A in the same manner as first top cut out 34. It should be appreciated that first top cut out 34 and first bottom cut out 34' need not be mirror images of each other and can take on any size and shape so long as they are at least as large as the locking portion of first locking button 36A.

First retractable handle 32A is operatively arranged between first top paddle playing surface 38A and first bottom paddle playing surface 38A'. As shown first retractable handle 32A comprises handle body 70, first locking button aperture 82, first locking button 36A, first outer prong 71A, first looped member 74A, center prong 73, second looped member 74B, and second outer prong 71B. First prong space 80A is located between first outer prong 71A and center prong 73 and top cross-brace 85A extends through first prong space 80A. Top cross-brace 85A is fixedly secured to first outer prong 71A and center prong 73. Similarly, second prong space 80B is located between center prong 73 and second outer prong 71B. Bottom cross-brace extends through second prong space 80B and is fixedly secured to center prong 73 and second outer prong 71B. First looped member 74A extends from handle body 70 and first locking button 36A in between first outer prong 71A and center prong 73. It should be appreciated that first looped member 74A could also extend from first outer prong 71A. First looped member 74A is fixedly secured to handle body 70 at first looped member outer end 75B. First looped member 74A is also fixedly secured to first locking button 36A at first looped member inner end 75A. Second looped member 74B mirrors first looped member 74A. Second looped member 74B extends from handle body 70 and first locking button 36A in between center prong 73 and second outer prong 71B. Again it should be appreciated that second looped member 74B could also extend from second outer prong 71B. Second looped member 74B is fixedly secured to handle body 70 at second looped member outer end 76B. Second looped member 74B is also fixedly secured to second locking button 36A at second looped member inner end 76A. First prong end 39A is fixedly secured to first outer prong 71A along first handle inner end 33A of first retractable handle 32A. Second prong end 39B is fixedly secured to second outer prong 71B also along first handle inner end 33A of first retractable handle 32A. First prong end 39A and second prong end 39B are mirror images of each other where second prong end 39B is three-dimensional and substantially "L" shaped. First prong end 39A is also three-dimensional and substantially backward "L" shaped. It should be appreciated that first prong end 39A and second prong end 39B can be any shape so long as each slidingly engage and abut within first paddle 30A.

First retractable handle 32A is operatively arranged to slidingly engage with, in part, broad channel surface 50 where broad channel surface is the upward-facing side of bottom paddle playing surface 38A' (not shown). Broad channel surface 50 comprises first bottom cut out 34', first outer alignment member 35A, and second outer alignment member 35B. Broad channel surface 50 is operatively arranged proximate to plurality of narrow channels, 62, 63, 64, 65, and 66 and plurality of baffles 60A, 60B, 60C, and 60D. Plurality of narrow channels 62, 63, 64, 65, and 66 (not shown) are operatively arranged to slidingly engage with first outer prong 71A, first looped member 74A, center prong 73, second looped member 74B, and second outer prong 71B respectively. Specifically, first outer prong 71A is operatively arranged to slide along narrow channel 62 (not shown) between baffle 60A and first outer alignment member 35A. First looped member 74A is operatively arranged to slide along narrow channel 63 (not shown) between baffle 60A and baffle 60B. Center prong 73 is operatively arranged to slide along narrow channel 64 (not shown) between baffle 60B and baffle 60C. Second looped member 74B is operatively arranged to slide along narrow channel 65 (not shown) between baffle 60C and baffle 60D. Second outer prong 71B is operatively arranged to slide along narrow channel 66 (not shown) between baffle 60D and second outer alignment member 35B. Baffles 60A and 60D have equal lengths and baffles 60B and 60C have equal lengths. The length of baffle 60A is equal to the length of the edge running from first prong end 39A to first looped member outer end 75B. The length of baffle 60D is equal to the length of the edge running from second prong end 39B to second looped member outer end 76B. The length of baffle 60B is equal to the length of the edge running from center prong 73 to first looped member inner end 75A. The length of baffle 60C is equal to the length of the edge running from center prong 73 to second looped member inner end 76A. It should be appreciated that the lengths of baffles 60A, 60B, 60C and 60D correspond to the lengths of first outer prong 71A, first looped member 74A, center prong 73, second looped member 74B and second outer prong 71B because they serve as stops when first retractable handle 32A is fully retracted. It should further be appreciated that the present invention could comprise any number of baffles or could have no baffles at all. Instead the present invention could comprise at least one abutment member located at the right most ends of baffles 60A, 60B, 60C and 60D. In another embodiment, the present invention could have no abutment member and first bottom sloping segment 43B could serve as the stop for first retractable handle 32A when first retractable handle 32A is fully retracted.

First outer alignment member 35A comprises three segments: first inner straight segment MA, first shoulder 79A, and first outer straight segment 52A. Second outer alignment member 35B also comprises three segments: second inner straight segment MB, second shoulder 79B, and second outer straight segment 52B. First outer alignment member 35A and second outer alignment member 35B are substantially similar in shape and operatively arranged to form mirror images of each other. As such first inner straight segment MA is identical to second inner straight segment MB. First outer straight segment 52A is identical to second outer straight segment 52B. First outer prong abutment shoulder 79A is identical to second outer prong abutment shoulder 79B. On top of being identical in shape, first inner straight segment MA is parallel to second inner straight segment MB. Similarly, first outer straight segment 52A is parallel to second outer straight segment 52B. As shown the distance between first inner straight segment MA and second inner straight segment MB is shorter than the distance between first outer straight segment 52A and second outer straight segment 52B. The extent of this difference in distances is equal to the length of first outer prong abutment shoulder 79A. The distance between first inner straight segment MA and second inner straight segment MB is slightly greater than the width of handle body 70.

As discussed above baffles 60A, 60B, 60C and 60D serve to stop first retractable handle 32A when it is fully retracted. When first retractable handle 32A is fully extended, first outer prong abutment shoulder 79A and second outer prong abutment shoulder 79B prevent first retractable handle 32A from extending further. First prong end 39A abuts first outer prong abutment shoulder 79A along first shoulder surface 41A when first retractable handle 32A is fully extended. Similarly, when first retractable handle 32A is fully extended, second prong end 39B abuts second outer prong abutment shoulder 79B along second shoulder surface 41B.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claim is:

1. A portable ping-pong set, comprising:

a net assembly comprising a first post having a first base member, a second post having a second base member, and a net secured within each of said first and second posts and extendible therebetween, said first and second base members operatively arranged to form an assembly base when said first and second base members are proximate one another, said assembly base having a first shape; and, at least one paddle having a blade and retractable handle, said at least one paddle having a second shape, wherein said first shape and said second shape are substantially similar when said handle is retracted into said blade.

2. The portable ping-pong set recited in claim 1, wherein said first and second base members are operatively arranged to form said assembly base when said first and second base members abut one another.

3. The portable ping-pong set recited in claim 1, wherein said first post comprises a partial through-bore operatively arranged to hold at least one ping-pong ball.

4. The portable ping-pong set recited in claim 3, wherein said partial through-bore is cylindrical.

5. The portable ping-pong set recited in claim 1, wherein said second post comprises a partial through-bore operatively arranged to hold a retractor, said retractor operatively arranged to retract said net.

6. The portable ping-pong set recited in claim 5, wherein said retractor is arranged within said second post.

7. The portable ping-pong set recited in claim 5, wherein said retractor is manual.

8. The portable ping-pong set recited in claim 1, wherein said first post has a height, H1, and said first post has a center of gravity, CG1, and said center of gravity is located within a bottom one third of said height.

9. The portable ping-pong set recited in claim 1, wherein said second post has a height, H2, and said first post has a center of gravity, CG2, and said center of gravity is located within a bottom one third of said height.

10. The portable ping-pong set recited in claim 1, wherein said first post has a height, H1, said second post has a height, H2, and heights H1 and H2 are equal.

11. The portable ping-pong set recited in claim 1, wherein said first shape is bounded by a perimeter, and said perimeter is oval in shape.

12. The portable ping-pong set recited in claim 1, wherein said first shape is bounded by a perimeter, and said perimeter is elliptical in shape.

13. The portable ping-pong set recited in claim 1, wherein said first shape is bounded by a perimeter, and said perimeter is circular in shape.

14. The portable ping-pong set recited in claim 1, wherein said first post has at least one weight operatively arranged within said first base member.

15. The portable ping-pong set recited in claim 1, wherein said second post has at least one weight operatively arranged within said second base member.

16. The portable ping-pong set recited in claim 1, wherein said first post has a weight in the range of 1-2 pounds.

17. The portable ping-pong set recited in claim 16, wherein said first post weighs approximately 1.3 pounds.

18. The portable ping-pong set recited in claim 1, wherein said second post has a weight in the range of 1-2 pounds.

19. The portable ping-pong set recited in claim 18, wherein said second post weighs approximately 1.3 pounds.

* * * * *